US009090094B2

(12) United States Patent
Nagumo

(10) Patent No.: US 9,090,094 B2
(45) Date of Patent: Jul. 28, 2015

(54) DRIVING CIRCUIT AND APPARATUS, AND IMAGE FORMING APPARATUS

(75) Inventor: Akira Nagumo, Takasaki (JP)

(73) Assignee: Oki Data Corporation, Tokyo (JP)

( * ) Notice: Subject to any disclaimer, the term of this patent is extended or adjusted under 35 U.S.C. 154(b) by 1061 days.

(21) Appl. No.: 13/021,799

(22) Filed: Feb. 7, 2011

(65) Prior Publication Data

US 2011/0193924 A1 Aug. 11, 2011

(30) Foreign Application Priority Data

Feb. 10, 2010 (JP) ..... 2010-027905

(51) Int. Cl.

| | |
|---|---|
| ***B41J 2/435*** | (2006.01) |
| ***G05F 3/16*** | (2006.01) |
| ***G05F 3/20*** | (2006.01) |
| ***G05F 1/10*** | (2006.01) |
| ***G05F 3/02*** | (2006.01) |
| ***B41J 2/45*** | (2006.01) |
| ***G05F 3/30*** | (2006.01) |
| *G05F 3/26* | (2006.01) |

(52) U.S. Cl.
CPC ... *B41J 2/45* (2013.01); *G05F 3/30* (2013.01); *G05F 3/26* (2013.01)

(58) Field of Classification Search
None
See application file for complete search history.

(56) References Cited

U.S. PATENT DOCUMENTS 6,028,472 A * 2/2000 Nagumo ..... 327/512

FOREIGN PATENT DOCUMENTS

| | | | |
|---|---|---|---|
| JP | H06-164359 | A | 6/1994 |
| JP | 10332494 | A | 12/1998 |
| JP | 2005-116616 | A | 4/2005 |
| JP | 2006-159472 | A | 6/2006 |
| JP | 2008-148101 | A | 6/2008 |
| JP | 2009-296123 | A | 12/2009 |
| WO | 2005062150 | A1 | 7/2005 |

* cited by examiner

*Primary Examiner* — Uyen Chau N Le
*Assistant Examiner* — John M Bedtelyon
(74) *Attorney, Agent, or Firm* — Panitch Schwarze Bellisario & Nadel LLP

(57) ABSTRACT

A driving circuit includes a reference voltage generating circuit and a driver circuit. The driver circuit drives a driven element at a level determined by the reference voltage output by the reference voltage generating circuit. The reference voltage generating circuit includes a regulating section that generates a regulated voltage, a temperature compensation section that applies a temperature compensation to the regulated voltage to compensate for the temperature characteristics of the driven element, and a voltage amplifying section that amplifies the resulting temperature compensated voltage to generate the reference voltage, thereby supplying a reference voltage high enough to avoid noise effects.

15 Claims, 16 Drawing Sheets

DRIVING CIRCUIT AND APPARATUS, AND IMAGE FORMING APPARATUS

BACKGROUND OF THE INVENTION

1. Field of the Invention

The present invention relates to a driving circuit for driving a driven element, a driving apparatus including the driving circuit and the driven element, and an image forming apparatus including the driving apparatus.

2. Description of the Related Art

Driven elements such as light-emitting diodes (LEDs), organic electroluminescence elements (organic light-emitting diodes or OLEDs), and light-emitting thyristors generally have temperature dependencies. The LEDs used as light-emitting elements in the optical print heads (LED heads) of LED printers, which are a type of electrophotographic printer, emit less optical power as their temperature rises. Since the printing darkness of an LED printer varies depending on the emitted optical power, the LED drive current must be changed to compensate for variations in emitted optical power caused by such temperature changes.

As disclosed, for example, by Nagumo in U.S. Pat. No. 6,028,472 (Japanese Patent Application Publication No. H10-332494) and Japanese Patent Application Publication No. 2006-159472 (now Japanese patent No. 4498905), an LED printer has a plurality of LEDs, driver integrated circuits (ICs) for feeding drive current to the LEDs, and a reference voltage generating circuit for supplying a reference voltage to the driver ICs. The drive current fed to the LEDs is proportional to the reference voltage applied to the driver ICs, so for temperature compensation, the reference voltage generating circuit in the above disclosures operate with a positive temperature coefficient that causes the reference voltage to increase as the temperature rises.

The reference voltage generating circuit disclosed in U.S. Pat. No. 6,028,472 outputs a voltage substantially proportional to absolute temperature. The reference voltage generating circuit disclosed in JP 2006-159472 provides a temperature coefficient that can be set to different values by selection of suitable components.

An LED head must hold the emitted optical power of the LEDs at the prescribed level as the LED temperature rises even if the temperature rise is due to the driving of the LEDs. There is also a need for a temperature compensation circuit having a temperature coefficient that is flexibly settable according to the temperature characteristics and luminous efficiency of the LEDs, which vary depending on the crystalline material and emission wavelength.

For LEDs with some characteristics, the reference voltage generating circuit in U.S. Pat. No. 6,028,472, which outputs a reference voltage proportional to absolute temperature, is unable to perform appropriate temperature compensation.

JP 2006-159472 discloses a reference voltage generating circuit with an internal diode-generated forward voltage drop. The voltage drop has a temperature coefficient that compensates for the temperature coefficient of the LEDs, but if the voltage drop is made large enough to obtain an adequate range of compensation, the reference voltage supplied to the driver ICs is reduced to such a low value that voltage noise effects etc. become significant. In the presence of such noise effects, it becomes difficult to specify a reference voltage that produces the desired output from the LEDs.

SUMMARY OF THE INVENTION

An object of the present invention is to provide a driving circuit that can provide correct temperature compensation for a variety of driven elements, without suffering from noise effects.

The invention provides a driving circuit for driving a driven element. The driving circuit includes a reference voltage generating circuit for generating a reference voltage, and a driver circuit for driving the driven element at a level responsive to the reference voltage.

In some embodiments, the reference voltage generating circuit includes a regulating section that generates a first voltage, a temperature compensation section that generates a second voltage responsive to the first voltage, and a voltage amplifying section that generates the reference voltage by amplifying the second voltage.

The reference voltage generating circuit may include a bipolar transistor that operates with a temperature characteristic that compensates for the temperature characteristic of the driven element.

The amplification factor of the voltage amplifying section is high enough to provide a reference voltage resistant to noise voltage effects.

The temperature coefficient of the temperature compensation section and the amplification factor of the voltage amplifying section can be set independently, enabling the driving circuit to compensate for the temperature characteristics of various types of driven elements while maintaining a sufficiently high reference voltage level.

In an alternative embodiment, the driver circuit includes a control voltage generating circuit having a bipolar transistor that operates with a temperature characteristic that compensates for the temperature characteristic of the driven element. In this case the temperature compensation section and amplifying section of the reference voltage generating circuit may be omitted. The control voltage is generated from the reference voltage, and controls the driving level of the driven element.

The invention also provides a driving apparatus incorporating the invented driving circuit and the driven element, and an image forming apparatus incorporating this driving apparatus.

By providing temperature compensation without noise vulnerability, the invention reliably assures that the driven element provides uniform output as its temperature changes. In an image forming apparatus, this results in images of consistent quality, regardless of changes in driven element temperature.

DETAILED DESCRIPTION OF THE INVENTION

Figure 1:
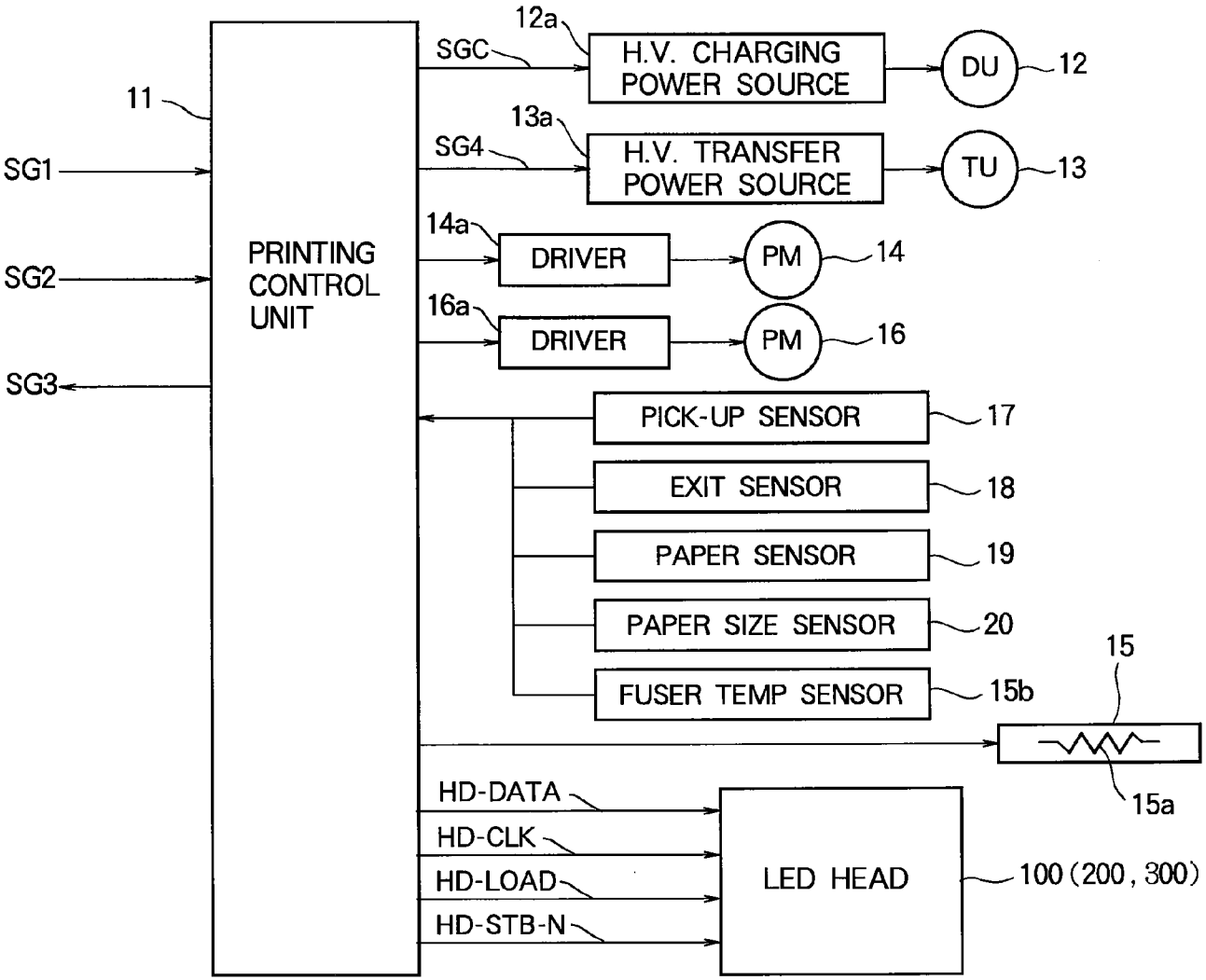
FIG. 1 is a block diagram schematically illustrating the functional configuration of an LED printer in which the invention may be used.

Embodiments of the invention will now be described with reference to the attached drawings, in which like elements are indicated by like reference characters.

First Embodiment

In an electrophotographic printer (an LED printer, for example), an optical print head (an LED head, for example) selectively illuminates the surface of a photosensitive drum according to print information to form a latent electrostatic image on the drum surface. The latent image is developed by application of toner to form a toner image, which is then transferred from the drum surface to paper and fixed onto the paper by heat and pressure.

Referring to FIG. 1, an LED printer according to the first embodiment includes a printing control unit 11, a developing unit (DU) 12, a high-voltage (H.V.) charging power source 12*a* that applies a voltage to the developing unit 12, a transfer unit (TU) 13, a high-voltage transfer power source 13*a* that applies a voltage to the transfer unit 13, a develop/transfer process motor (PM) 14, a motor driver 14*a* that drives the develop/transfer process motor 14, a fuser 15 with an internal heater 15*a*, a fuser temperature (Temp.) sensor 15*b*, a paper transport motor 16, a motor driver 16*a* that drives the paper transport motor 16, a pick-up sensor 17, an exit sensor 18, a paper sensor 19, a paper size sensor 20, and a LED head 100 (reference characters 200 and 300 being used in the second and third embodiments).

The printing control unit 11 includes a microprocessor, a read-only memory (ROM), a random access memory (RAM), input-output ports, timers, and other well-known facilities (not shown). The printing control unit 11 forms part of a printing unit (not shown) that uses the LED printer to execute printing operations. The printing control unit 11 controls the printing operations of the LED printer in response to a control signal SG1, a data signal SG2, etc. received from an image processing unit (not shown), and sends the LED head 100 a print data signal HD-DATA, clock signal HD-CLK, latch signal HD-LOAD, and negative-logic strobe signal HD-STB-N. The data signal SG2 is sometimes referred to as a video signal because it supplies dot-mapped data one-dimensionally.

When the printing control unit 11 receives a printing command by means of control signal SG1, it checks the fuser temperature sensor 15*b* to determine whether the fuser 15 is at the necessary temperature for printing. If it is not, current is fed to the heater 15*a* to raise the temperature of the fuser 15. Next, the printing control unit 11 commands motor driver 14*a* to turn the develop/transfer process motor 14 and concurrently turns on the high-voltage charging power source 12*a* by means of a charge signal SGC to charge the developing unit 12.

Next, the printing control unit 11 checks the paper sensor 19 to confirm that paper is present in a cassette (not shown), checks the paper size sensor 20 to determine the type of the paper, and commands the motor driver 16*a* to turn the paper transport motor 16. The paper transport motor 16 turns in the reverse direction bring a sheet of paper out of the cassette, and stops turning when the pick-up sensor 17 detects the paper. Next, the paper transport motor 16 turns in the forward direction to transport the paper into the printing mechanism in the LED printer.

When the paper is in position for printing, the printing control unit 11 sends the image processing unit a timing signal SG3 (including a main scanning synchronization signal and a sub-scanning synchronization signal) and receives the video signal SG2. The image processing unit responds by sending edited dot data for one page in the video signal SG2. The printing control unit 11 sends corresponding dot data (HD-DATA) to the LED head 100 in synchronization with the clock signal (HD-CLK). The LED head 100 comprises a linear array of LEDs for printing respective dots (also referred to as picture elements or pixels). After receiving data for one line of dots in the video signal SG2 and sending the data to the LED 100, the printing control unit 11 sends the LED head 100 the latch signal (HD-LOAD), causing the LED head 100 to store the print data (HD-DATA). The print data stored in the LED head 100 can then be printed while the printing control unit 11 is receiving the next print data from the image processing unit in the video signal SG2.

The video signal SG2 is transmitted and received one printing line at a time. For each line, the LED head 100 forms a latent image of dots with a comparatively high electric potential on the photosensitive drum (not visible), which is negatively charged. In the developing unit 12, negatively charged toner is electrically attracted to the dots, forming a toner image. The drum and toner are both charged by the high-voltage charging power source 12*a*.

The toner image is then transported to the transfer unit 13. The printing control unit 11 activates the high-voltage transfer power source 13*a* by sending it a transfer signal SG4, and the toner image is transferred to the sheet of paper as it passes between the photosensitive drum and transfer unit 13. The sheet of paper carrying the transferred toner image is transported to the fuser 15, where the toner image is fused onto the paper by heat generated by the heater 15*a*. Finally, the sheet of paper carrying the fused toner image is transported out of the printing mechanism, passing the exit sensor 18, and ejected from the printer.

The printing control unit 11 controls the high-voltage transfer power source 13*a* according to the information detected by the pick-up sensor 17 and size sensor 20 so that voltage is applied to the transfer unit 13 only while paper is passing through the transfer unit 13. When the paper passes the exit sensor 18, the printing control unit 11 stops the supply of voltage from the high-voltage charging power source 12*a* to the developing unit 12, and halts the turning of the photosensitive drum and various rollers (not shown) driven by the develop/transfer process motor 14. The above operations are repeated to print a series of pages.

The LED head 100 according to the first embodiment will be described with reference to FIG. 2. The LED head 100 includes a plurality of LED arrays, a plurality of driver integrated circuits (ICs), and a reference voltage generating circuit 40. The description below concerns an exemplary LED head 100 capable of printing on A4 paper with a resolution of 600 dots per inch, having a total of 4,992 LEDs disposed in twenty-six LED array chips (CHP1, CHP2, . . . , CHP26), each including 192 LEDs, driven by corresponding driver ICs (IC1, IC2, . . . , IC26), so that each driver chip drives 192 LEDs. The LED array chips other than CHP1, CHP2, and CHP26 and the driver ICs other than IC1, IC2, and IC26 are omitted from the drawing. The twenty-six LED array chips (CHP1, CHP2, . . . , CHP26) and twenty-six driver ICs (IC1, . . . , IC26) are aligned in mutually facing rows on a printed wiring board (not shown). The driver ICs, IC1, . . . , IC26 are interconnected in cascade, so that print data externally input to IC1 can be serially transferred to the other driver ICs (IC2, . . . , IC26). The reference voltage generating circuit 40 supplies a reference voltage (Vr) to all the driver ICs (IC1, . . . , IC26).

The driver ICs all have the same internal circuit configuration. In this configuration, a shift resister circuit 31 receives the clock signal HD-CLK and serially transfers the print data. A latch circuit 32 latches data signals output from the shift resister circuit 31 in parallel according to the latch signal (HD-LOAD). An inverter 33 receives the strobe signal (HD-STB-N). A NAND circuit 34 receives the outputs of the latch circuit 32 and the inverter circuit 33. An LED drive circuit 35 supplies drive current from a power source node VDD to the LED array chips (CHP1 etc.) according to signals output from the NAND circuit 34. A control voltage generating circuit 36 for generates a control voltage that controls the drive currents output from the LED drive circuit 35 so that they remain constant despite possible fluctuations in the power source potential.

Figure 2:
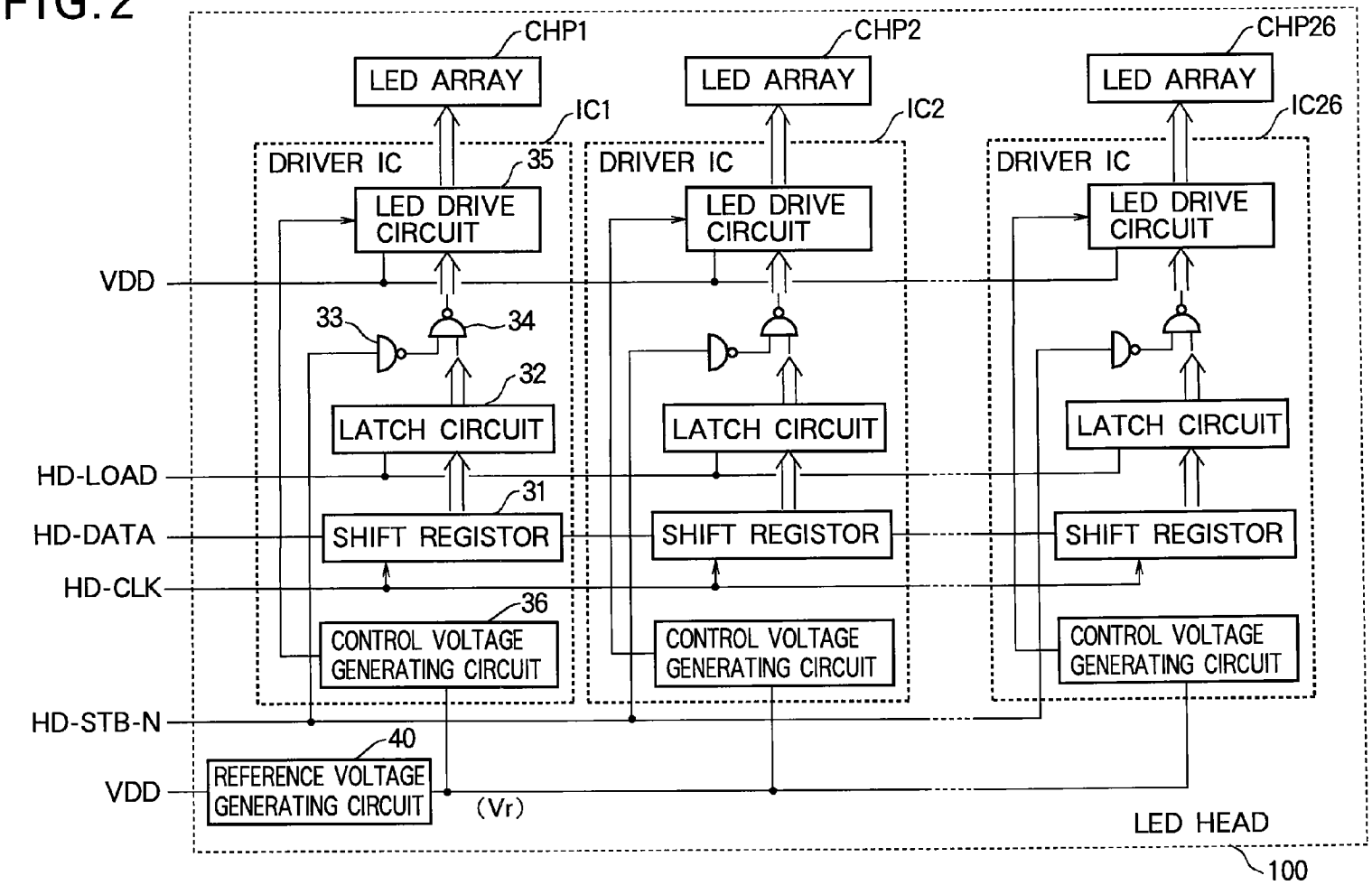
FIG. 2 is a block diagram schematically illustrating the functional configuration of the LED head in FIG. 1 in a first embodiment of the invention.

In this embodiment, the driven elements are the LEDs (not shown) in the LED arrays CHP1 to CHP26. The driving circuit includes the driver ICs IC1 to IC26 and the reference voltage generating circuit 40. The LED head 100 as a whole is the driving apparatus:

The LED head 100 in FIG. 2 includes a single reference voltage generating circuit 40 for all the driver ICs, but other configurations are possible. For example, a plurality of reference voltage generating circuits may be provided, one for each of the driver ICs IC1 to IC26.

Figure 3:
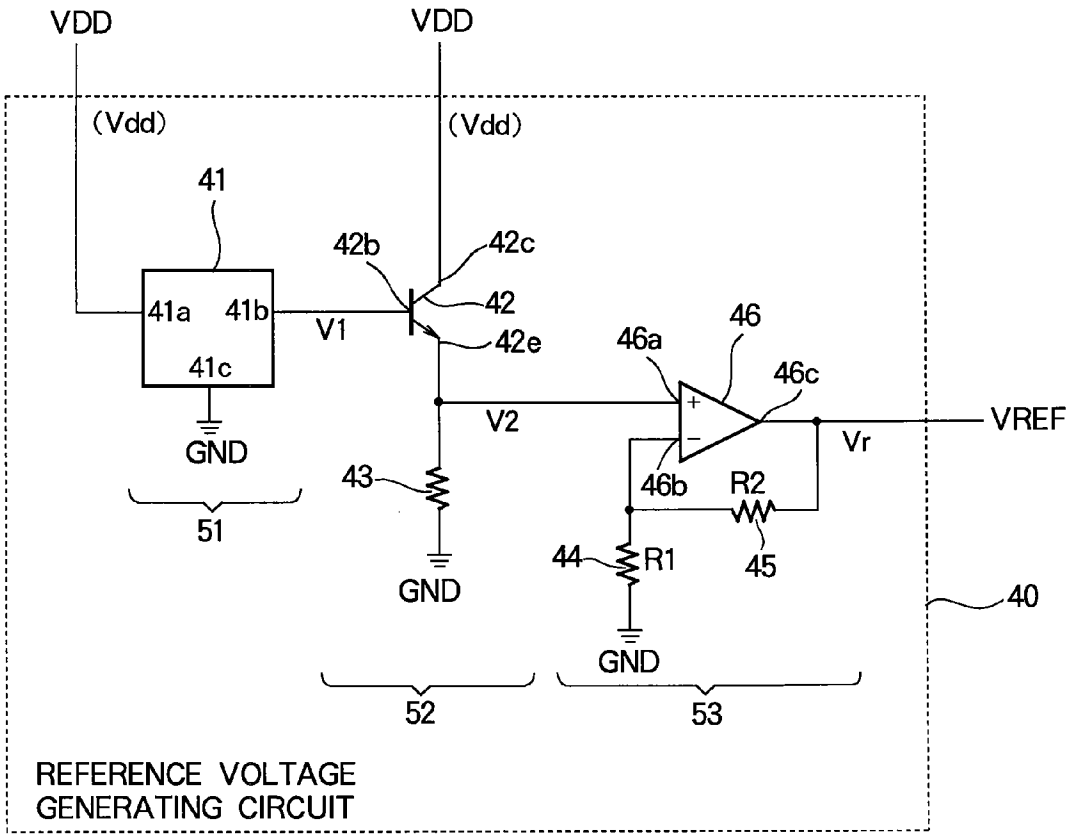
FIG. 3 is a circuit diagram schematically illustrating the reference voltage generating circuit in FIG. 2.

Referring to FIG. 3, the reference voltage generating circuit 40 includes a regulator circuit 41, an npn bipolar transistor 42, resistors 43, 44, 45, and an operational amplifier 46.

The driving circuit receives a first power source potential at various nodes denoted VDD in the drawings, and a second power source potential various nodes denoted by the ground symbol and the letters GND. The VDD nodes will be referred to collectively as the power source VDD; the ground (GND) nodes will be referred to simply as ground. In the embodiments described herein, the first power source potential (also denoted Vdd) is positive with respect to the second power source potential. These power source potentials are supplied to all the driver ICs in FIG. 2.

The regulator circuit 41 has a power terminal 41*a* connected to the power source VDD, an output terminal 41*b* connected to the control terminal or base terminal 42*b* of the npn bipolar transistor 42, and a ground terminal 41*c* connected to ground. The npn bipolar transistor 42 has its first main terminal or emitter terminal 42*e* connected to ground through resistor 43, and its second main terminal or collector terminal 42*c* connected to the power source VDD. The npn bipolar transistor 42 and resistor 43 constitute an emitter-follower circuit. The emitter terminal 42*e* of the npn bipolar transistor 42 is also connected to the non-inverting input terminal 46*a* of the operational amplifier 46. One terminal of resistor 44 and one terminal of resistor 45 are connected to the inverting input terminal 46*b* of the operational amplifier 46. The other terminal of resistor 44 is grounded, and the other terminal of resistor 45 is connected to the output terminal 46*c* of the operational amplifier 46. The output terminal 46*c* of the operational amplifier 46 is connected to the output terminal VREF of the reference voltage generating circuit 40.

The output voltage V1 of the regulator circuit 41 remains substantially constant, with respect to ground, despite variations in the first power source potential. The regulator circuit 41 may also be designed so that its output voltage V1 remains substantially constant despite temperature variations, that is, so that V1 has a zero temperature coefficient. The value of the output voltage V1 is a design choice that can be made by selecting appropriate components for the regulator circuit 41, if the regulator circuit 41 is configured using discrete components, or by selecting an appropriate type of regulator circuit 41, if the regulator circuit 41 is obtained as an integrated circuit from an IC manufacturer. In either case, the optimum output voltage V1 should be selected according to the other design conditions of the driving apparatus.

Figure 4:
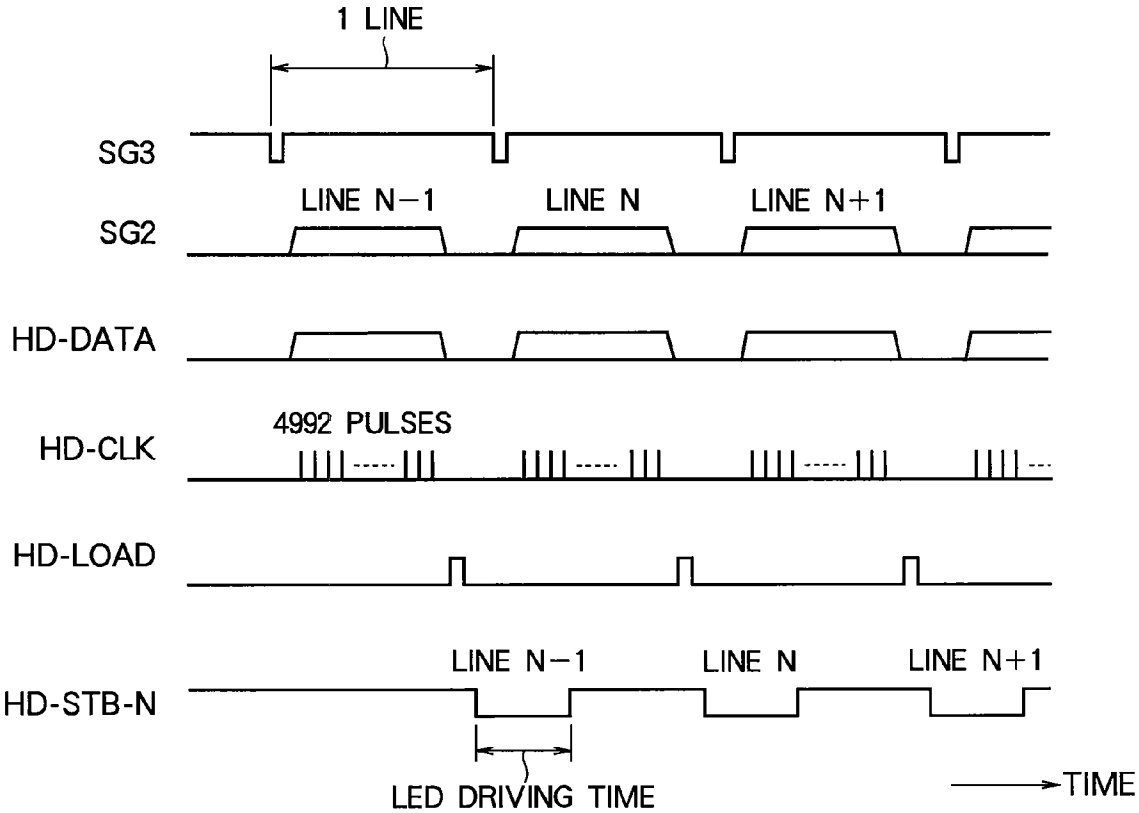
FIG. 4 is a timing diagram illustrating the operation of the LED head in FIG. 1.

The operation of the first embodiment will now be described. Referring to the timing diagram in FIG. 4, first, at the start of a printing operation, a synchronization signal SG3 is generated and transmitted to the image processing unit (not shown). In synchronization with this operation, the clock signal HD-CLK and print data signal HD-DATA are input to the LED head 100. Since the LED head 100 has 4,992 LEDs, 4992 HD-CLK pulses are generated. Following the 4992 HD-CLK pulses, an HD-LOAD pulse is output and the print data that have been input to the shift register 31 in the LED head 100 are loaded into the latch circuit 32 and latched. Next, a strobe signal HD-STB-N is generated to drive the light emitting diodes. While the strobe signal is at the low logic level, the LEDs emit light toward the photosensitive drum.

For comparison with the reference voltage generating circuit 40 in FIG. 3, a conventional reference voltage generating circuit (taken from JP 2006-159472) will now be described with reference to FIG. 5. The reference voltage generating circuit 90 in FIG. 5 includes a regulator circuit 41, an npn bipolar transistor 42, and resistors 61 and 62. As in FIG. 3, the regulator circuit 41 has its power terminal 41*a* connected to the power source VDD, its output terminal 41*b* connected to the base terminal 42*b* of the npn bipolar transistor 42, and its ground terminal 41*c* connected to ground. The npn bipolar transistor 42 has its collector terminal 42*c* connected to the power source VDD and its emitter terminal 42*e* connected to ground through the resistors 61 and 62, which are connected in series. A node between resistors 61 and 62 is connected to the reference voltage output terminal VREFa.

As noted above, the output voltage of the regulator circuit 41 is substantially independent of the potential Vdd of the power source VDD. If the output voltage of the regulator circuit 41 is denoted V1, the base-emitter potential of the npn bipolar transistor 42 is denoted Vbe, the potential at the emitter terminal 42*e* of the npn bipolar transistor 42 is denoted V2, and the resistance values of resistors 61 and 62 are denoted R61 and R62, respectively, the emitter potential V2 is given by the following equation (1)

$$V2=V1-Vbe \quad (1)$$

hand the reference voltage Vra output at the VREFa terminal is given by the following equation (2).

$$Vra = V2 \times R61/(R61 + R62) = (V1 - Vbe) \times R61/(R61 + R62) \quad (2)$$

V1 is the known output voltage of the regulator circuit 41. The base-emitter voltage Vbe is a known characteristic of the npn bipolar transistor 42 and can be considered to be approximately 0.6 V. The base-emitter voltage Vbe of the npn bipolar transistor 42 has a negative temperature dependency, that is, Vbe decreases as the temperature increases. The temperature coefficient of Vbe is approximately minus two millivolts per degree Celsius (−2 mV/° C.). It will be assumed below that resistors 61 and 62 are of identical type or material and have identical temperature dependencies. Their temperature dependencies then cancel in the term R61/(R61+R62) on the right in equation (2), so this term can be ignored when the temperature dependency of the output voltage Vra is considered.

On this basis, the temperature coefficient Tc of the output voltage Vra of the conventional reference voltage generating circuit in FIG. 5 can be calculated as follows. The temperature coefficient Tc is defined by the following equation (3).

$$Tc = \frac{1}{Vref} * \frac{\partial Vref}{\partial T} \quad (3)$$

Figure 5:
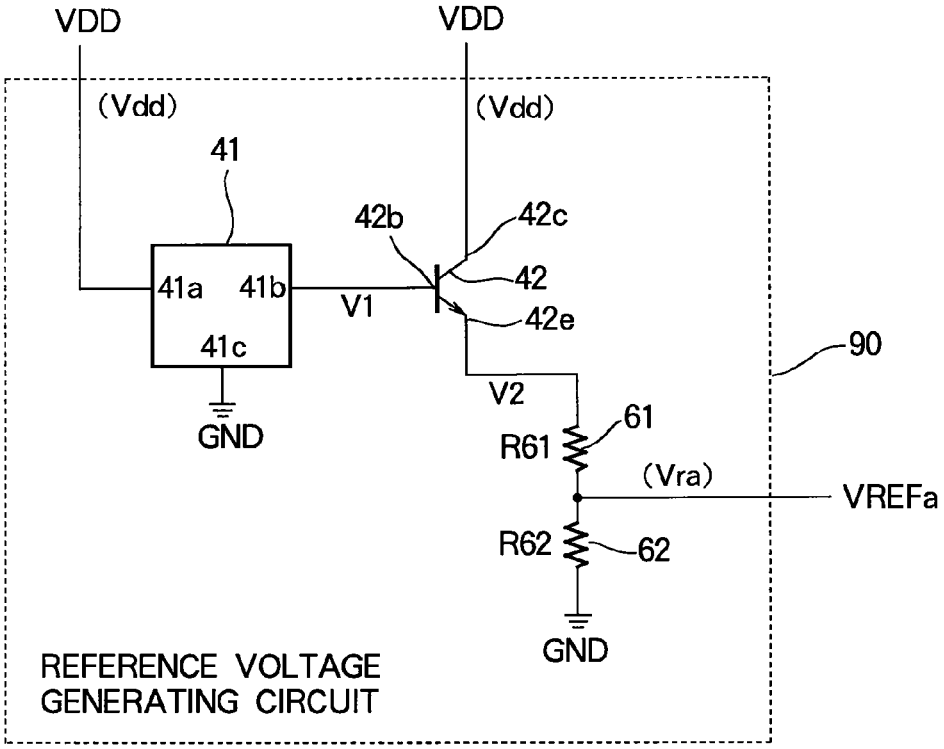
FIG.5 PRIOR ART
FIG. 5 is a circuit diagram schematically illustrating a conventional reference voltage generating circuit.

Assuming that the temperature coefficient of the output voltage of the regulator circuit 41 is negligible, the temperature coefficient Tc of the reference voltage Vra at the VREFa terminal of the reference voltage generating circuit 90 in FIG. 5 is given by the following equation (4).

$$Tc = \frac{1}{V1 - Vbe}\left(\frac{\partial V1}{\partial T} - \frac{\partial Vbe}{\partial T}\right) \cong \frac{-1}{V1 - Vbe} * \frac{\partial Vbe}{\partial T} \quad (4)$$

From equations (1) and (4), comparative examples 1 to 4 can be obtained for the temperature coefficient Tc and reference voltage Vra in FIG. 5.

Comparative Example 1

If V1 is 1.4 V (V1=1.4 V), the temperature coefficient Tc is:

$$Tc = 1/(1.4\ \text{V} - 0.6\ \text{V}) \times 2\ \text{mV}/^\circ\ \text{C.} = +0.25\%/^\circ\ \text{C.}$$

If R61 is zero, the reference voltage Vra at the VREFa terminal is:

$$Vra = V1 - Vbe = 0.8\ \text{V}$$

Comparative Example 2

If V1 is 1.2 V (V1=1.2 V), the temperature coefficient Tc is:

$$Tc = 1/(1.2\ \text{V} - 0.6\ \text{V}) \times 2\ \text{mV}/^\circ\ \text{C.} = +0.33\%/^\circ\ \text{C.}$$

If R61 is zero, the reference voltage Vra at the VREFa terminal is:

$$Vra = V1 - Vbe = 0.6\ \text{V}$$

Comparative Example 3

If V1 is 0.9 V (V1=0.9 V), the temperature coefficient Tc is:

$$Tc = 1/(0.9\ \text{V} - 0.6\ \text{V}) \times 2\ \text{mV}/^\circ\ \text{C.} = +0.66\%/^\circ\ \text{C.}$$

If R61 is zero, the reference voltage Vra at the VREFa terminal is:

$$Vra = V1 - Vbe = 0.3\ \text{V}$$

Comparative Example 4

If V1 is 0.8 V (V1=0.8 V), the temperature coefficient Tc is:

$$Tc = 1/(0.8\ \text{V} - 0.6\ \text{V}) \times 2\ \text{mV}/^\circ\ \text{C.} = +1.0\%/^\circ\ \text{C.}$$

If R61 is zero, the reference voltage Vra at the VREFa terminal is:

$$Vra = V1 - Vbe = 0.2\ \text{V}$$

Different types of LEDs are used to obtain different wavelengths of emitted light, and these different types have different temperature characteristics. To provide temperature compensation, the different types of LEDs therefore require different drive current temperature coefficients. An aluminum gallium arsenide (AlGaAs) LED requires a drive current temperature coefficient of approximately 0.25%/° C. A gallium arsenide (GaAs) LED requires a drive current temperature coefficient of approximately 0.6%/° C. An aluminum gallium indium phosphorus (AlGaInP) LED requires a drive current temperature coefficient of approximately 1%/° C.

These differing requirements are met by changing the output voltage value V1 for the regulator circuit 41, but as comparative examples 1-4 indicate, to obtain a temperature coefficient as high as +1.0%/° C., the reference voltage Vra must be reduced to the value of 0.2 V. A reference voltage this low is highly vulnerable to noise voltage effects in the driver ICs and the wiring traces by which they are connected to the reference voltage generating circuit. A low reference voltage is particularly undesirable if, as in FIG. 2, a single reference voltage generating circuit controls a plurality of driver ICs, because noise voltage effects may cause considerable variation in LED drive current among the driver ICs.

Referring again to FIG. 3, the reference voltage generating circuit 40 in the first embodiment can be divided into a regulating section 51 and temperature compensation section 52, which in combination are similar to the reference voltage generating circuit 90 in the comparative example in FIG. 5, and a voltage amplifying section 53, which is not present in FIG. 5. The temperature coefficient Tc of the potential V2 in FIG. 3 is given by the same equation (4) as the temperature coefficient of the output voltage of the reference voltage generating circuit 90 in FIG. 5.

$$Tc = \frac{1}{V1 - Vbe}\left(\frac{\partial V1}{\partial T} - \frac{\partial Vbe}{\partial T}\right) \cong \frac{-1}{V1 - Vbe} * \frac{\partial Vbe}{\partial T} \quad (4)$$

In FIG. 3, R1 denotes the resistance value of the resistor 44 connected between the inverting input terminal 46*b* of the operational amplifier 46 and ground, and R2 denotes the resistance value of the resistor 45 connected between the output terminal 46*c* and the inverting input terminal 46*b* of the operational amplifier 46. Feedback through resistor 45 forces the potential at the inverting input terminal 46*b* to be equal to the potential at the non-inverting input terminal 46*a*. Accordingly, the reference voltage Vr at the VREF terminal of the reference voltage generating circuit 40 is expressed by the following equation (5).

$$Vr=\{1+(R2/R1)\}\times V2 \quad (5)$$

According to equation (1), $$V2=V1-Vbe$$

From equations (1) and (5), the following equation (6) is obtained.

$$Vr=\{1+(R2/R1)\}\times(V1-Vbe) \quad (6)$$

These equations indicate that the voltage amplifying section 53 generates the reference voltage Vr by amplifying the voltage V2 generated in the temperature compensation section 52 by a factor of (1+R2/R1), and can therefore increase the reference voltage Vr by this factor (1+R2/R1) without changing the temperature coefficient of the voltage V2. As an example, if the ratio of R1 to R2 is one to five (1:5), a reference voltage Vr equal to six times the value of V2 can be obtained.

This provides the following example of the temperature coefficient Tc and reference voltage Vr in the first embodiment.

Example 5

If V1 is 0.8 V (V1=0.8 V), the temperature coefficient Tc is:

$$Tc = 1/(0.8\ \text{V} - 0.6\ \text{V}) \times 2\ \text{mV}/^\circ\ \text{C}.$$

$$= +1.0\%/^\circ\ \text{C}.$$

If R2/R1 is five (R2/R1=5), the reference voltage Vr at the VREF terminal is:

$$Vr = (1 + R2/R1) \times (V1 - Vbe)$$

$$= (1 + 5) \times (0.8\ V - 0.6\ \text{V})$$

$$= 1.2\ \text{V}$$

Whereas the reference voltage Vra is only 0.2 V in the corresponding comparative example (4) for the conventional reference voltage generating circuit 90 in FIG. 5, the reference voltage Vr in the reference voltage generating circuit 40 in FIG. 3 in the first embodiment can provide a reference voltage of 1.2 V, which is large enough to reduce noise voltage effects to a negligible level.

The presence of the operational amplifier 46 in the voltage amplifying section 53 adds to the cost of the reference voltage generating circuit 40 in the first embodiment. Even if reference voltage generating circuit 40 is manufactured as a monolithic integrated circuit chip, the operational amplifier 46 occupies relatively large chip area, increasing the chip cost. However, as seen from Example 5 above, to obtain the temperature coefficient of +1.0%/° C. needed for temperature compensation of AlGaInP LEDs, the reference voltage generating circuit 40 in the first embodiment is preferable despite the additional cost.

To summarize the first embodiment, the regulating section 51 (regulator circuit 41) used in the reference voltage generating circuit 40 (FIG. 3) can output a prescribed voltage with a temperature coefficient of zero, regardless of variations in the input power source potential. The value of the base-emitter voltage Vbe of the npn bipolar transistor used in the temperature compensation section 52 and its temperature coefficient Tc are known and their variations can be kept relatively small.

In the voltage amplifying section 53, any desired voltage amplification factor can be obtained by selecting resistance values R1 and R2 that produce a suitable ratio (R1/R2). Moreover, the temperature coefficient of the voltage amplifying section 53 itself is negligibly small. As a result, the temperature coefficient Tc of the reference voltage Vr can be set by selecting a regulating section 51 with a suitable output voltage, and the value of the reference voltage Vr can be set independently from the temperature coefficient Tc, by selecting suitable resistance values in the voltage amplifying section 53.

Accordingly, whereas in the configuration in the example in FIG. 5 a large temperature coefficient implies a low output reference voltage and attendant susceptibility to noise voltage effects, causing LED emission variations and problems such as uneven printing density, the driving circuit in the first embodiment permits independent setting of the reference voltage value and temperature coefficient, and can provide suitable and reliable temperature compensation for various types of LEDs, emitting light of various different wavelengths (colors).

Second Embodiment

Figure 6:
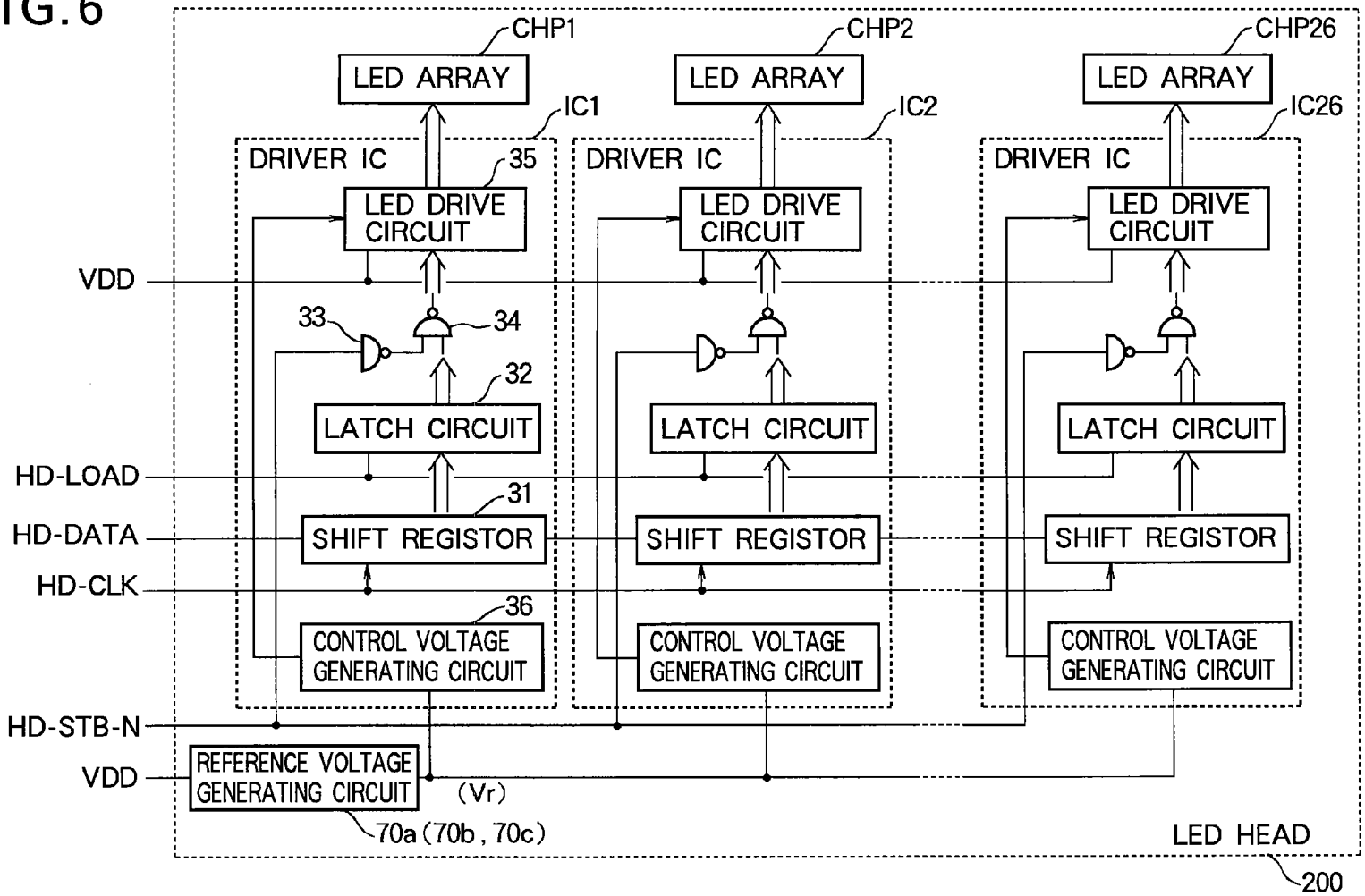
FIG. 6 is a block diagram schematically illustrating the functional configuration of the LED head in FIG. 1 in a second embodiment of the invention.

Referring to FIG. 6, the LED head 200 in the second embodiment has the same configuration as the LED head 100 in the first embodiment but differs in the internal configuration of the reference voltage generating circuit. Three exemplary reference voltage generating circuits 70*a*, 70*b*, 70*c* will be shown.

Figure 7:
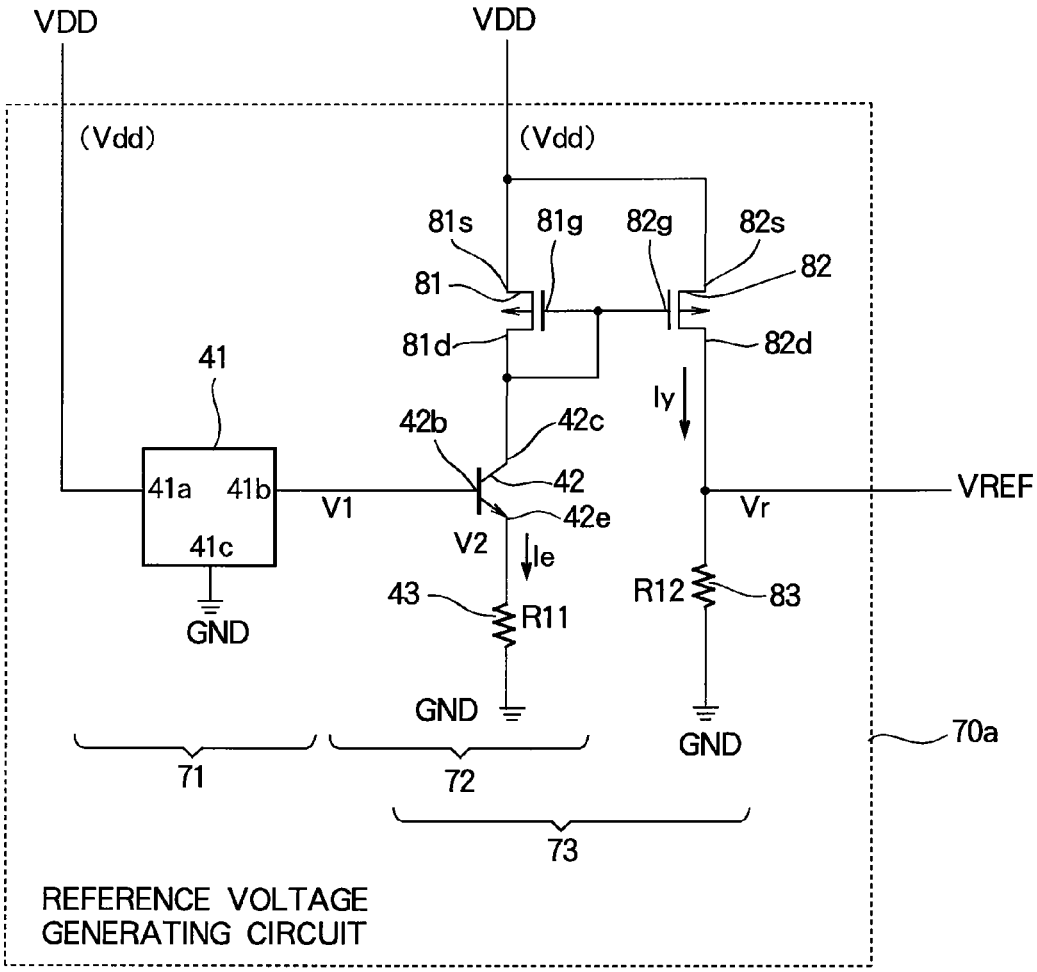
FIG. 7 is a circuit diagram schematically illustrating the reference voltage generating circuit in FIG. 6.

Referring to FIG. 7, reference voltage generating circuit 70*a* includes the regulator circuit 41, npn bipolar transistor 42, and resistor 43 described in the first embodiment, a pair of p-channel metal-oxide-semiconductor field effect transistors (PMOS transistors) 81, 82, and a resistor 83. As in the first embodiment, the regulator circuit 41 has a power terminal 41*a* connected to the power source VDD, a ground terminal 41*c* connected to ground, and an output terminal 41*b* connected to the base terminal 42*b* of the npn bipolar transistor 42. The npn bipolar transistor 42 has its emitter terminal 42*e* connected to ground through resistor 43, the npn bipolar transistor 42 and resistor 43 forming an emitter-follower circuit. The first main terminals or source terminals 81*s*, 82*s* of the PMOS transistors 81, 82 are connected to the power source VDD. The control terminals or gate terminals 81g, 82g of the PMOS transistors 81, 82 are mutually interconnected and are also connected to the second main terminal or drain terminal 81d of PMOS transistor 81 and the collector terminal 42c of the npn bipolar transistor 42.

The second main terminal or drain terminal 82d of PMOS transistor 82 is connected to ground through resistor 83. The drain terminal 82d of PMOS transistor 82 is connected to the output (VREF) terminal. The resistance values of resistors 43, 83 are denoted R11, R12, respectively, the potential at the output terminal 41b of the regulator circuit 41 is again denoted V1, the potential at the emitter terminal 42e of the npn bipolar transistor 42 is again denoted V2, and the potential at the VREF terminal is again denoted Vr. The emitter current of the npn bipolar transistor 42 is denoted Ie. The drain current of PMOS transistor 82 is denoted Iy. Overall, reference voltage generating circuit 70a is divided into three blocks: a regulating section 71 including the regulator circuit 41, a temperature compensation section 72 including the npn bipolar transistor 42 and resistor 43, and a voltage amplifying section 73 including the PMOS transistors 81, 82 and resistor 83.

Figure 8A:
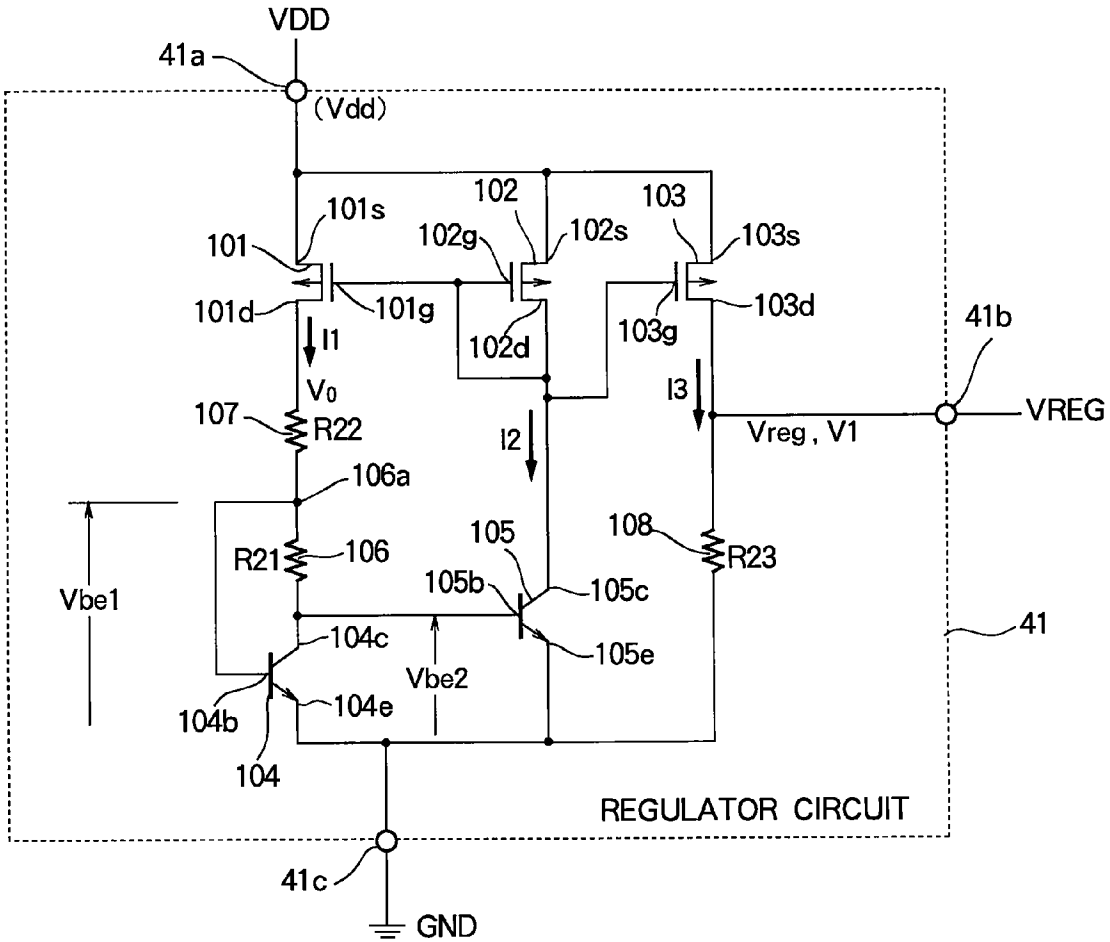
FIG. 8A is a circuit diagram schematically illustrating the regulator circuit in FIG. 7.

Referring to FIG. 8A, the regulator circuit 41 includes PMOS transistors 101, 102, 103, npn bipolar transistors 104, 105, and resistors 106, 107, 108. The source terminals 101s, 102s, 103s of the PMOS transistors 101, 102, 103 are connected to the power source VDD; their gate terminals 101g, 102g, 103g are interconnected. The drain terminal 101d of PMOS transistor 101 is connected to the base terminal 104b of npn bipolar transistor 104 through resistor 107. The drain terminal 102d of PMOS transistor 102 is connected to the gate terminals 101g, 102g, 103g of PMOS transistors 101, 102, 103, and to the collector terminal 105c of npn bipolar transistor 105. The drain terminal 103d of PMOS transistor 103 is connected to ground through resistor 108, and to a VREG terminal from which the voltage V1 indicated in FIG. 7 is output. The emitter terminals 104e, 105e of the npn bipolar transistors 104, 105 are connected to ground. The base terminal 104b and collector terminal 104c of npn bipolar transistor 104 are interconnected through resistor 106. The base terminal 105b of npn bipolar transistor 105 is connected to the collector terminal 104c of npn bipolar transistor 104. The emitter area of npn bipolar transistor 105 is N times the emitter area of npn bipolar transistor 104, where N is greater than one (N>1).

In FIG. 8A, the drain currents of the PMOS transistors 101, 102, 103 are denoted I1, I2, I3; the resistance values of the resistors 106, 107, 108 are denoted R21, R22, R23; the drain potential of PMOS transistor 101 is denoted $V_0$; the base-emitter voltage of npn bipolar transistor 104 is denoted Vbe1; the base-emitter voltage of npn bipolar transistor 105 is denoted Vbe2.

Figure 8B:
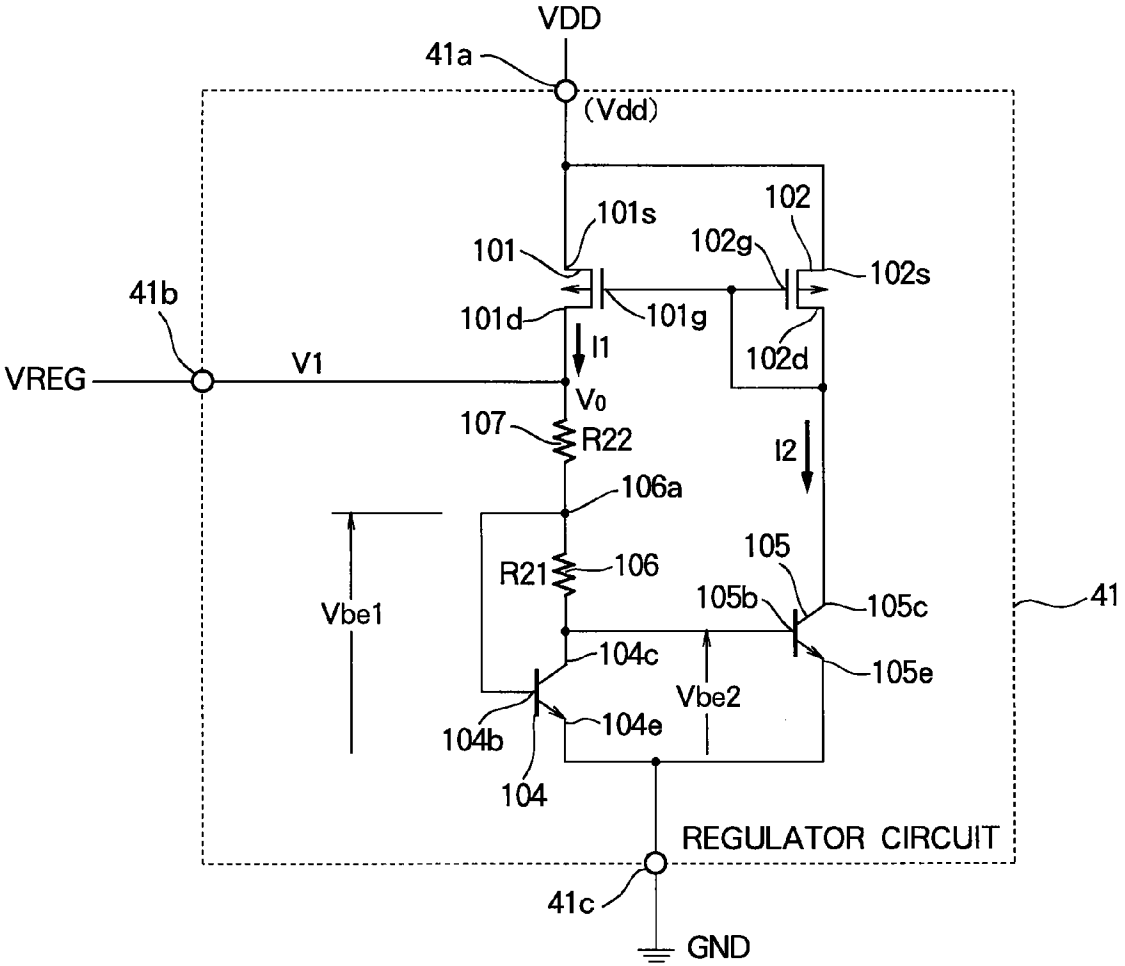
FIG. 8B is a circuit diagram schematically illustrating an alternative configuration of the regulator circuit in FIG. 7.

FIG. 8B shows an alternative configuration of the regulator circuit 41 in which PMOS transistor 103 and resistor 108 are omitted and the output terminal VREG is connected to the drain terminal 101d of PMOS transistor 101, so that the regulated output voltage is the drain potential $V_0$ of PMOS transistor 101.

To calculate the drain potential $V_0$ of PMOS transistor 101, first current I1 will be determined. Electronics theory teaches that the following equation (7) holds between the emitter current Ie and base-emitter voltage Vbe of an npn bipolar transistor.

$$Ie \cong Is^{*}\exp(qVbe/(kT)) \tag{7}$$

In this equation, Is indicates saturation current, which is a constant proportional to the device area of an npn bipolar transistor; the asterisk indicates multiplication; exp( ) indicates the exponential function; q indicates the electron charge, which is $1.6^{*}10^{-19}$ C; k is the Boltzmann constant, which is $1.38^{*}10^{-23}$ J/K; and T indicates absolute temperature, which is approximately 298 K at a room temperature of 25° C.

From equation (7), the following equation (8) is obtained.

$$Vbe=(kT/q)^{*}\ln(Ie/Is) \tag{8}$$

In this equation, ln( ) indicates the natural logarithm function. If Vbe1 and Vbe2 are the base-emitter voltages, Ie1 and Ie2 are the emitter currents, and Is1 and Is2 are the saturation currents of npn bipolar transistors 104 and 105, respectively, then equation (8) gives the following equations (9) and (10) for npn bipolar transistors 104 and 105.

$$Vbe1=(kT/q)^{*}\ln(Ie1/Is1) \tag{9}$$

$$Vbe2=(kT/q)^{*}\ln(Ie2/Is2) \tag{10}$$

In FIGS. 8A and 8B, the potentials at the two terminals of the resistor 106 with resistance value R21 are Vbe1 and Vbe2. The potential difference ΔVbe between the two terminals of resistor 106 is given by the following equation (11).

$$\Delta Vbe=Vbe1-Vbe2 \tag{11}$$

If equations (9) and (10) are substituted into equation (11) and the result is rearranged, the following equation (12) is obtained.

$$\begin{aligned}\Delta Vbe &= (kT/q)\times\{\ln(Ie1/Is1)-\ln(Ie2/Is2)\} \\ &= (kT/q)\times\ln\{(Is2/Is1)*(Ie1/Ie2)\}\end{aligned} \tag{12}$$

Since the ratio between the emitter areas of the npn bipolar transistors 104 and 105 is 1:N, where N>1, and the saturation current of a bipolar transistor is proportional to its emitter area, the following equation (13) is true.

$$Is2=Is1\times N \tag{13}$$

PMOS transistors 101 and 102 constitute a current mirror circuit. If their drain currents I1 and I2 have the same value, then the base-emitter currents Ie1 and Ie2 of the npn bipolar transistors 104 and 105 become identical and the following equation (14) is true.

$$\Delta Vbe=(kT/q)\times\ln(N) \tag{14}$$

The drain current I1 of PMOS transistor 101 substantially equals the current passing through the resistor 106 with resistance value R21, so the following equation (15) is true.

$$\begin{aligned}I1 &= \Delta Vbe/R21 \\ &= (1/R21)\times(kT/q)\times\ln(N)\end{aligned} \tag{15}$$

Since drain current I1 flows through the resistor 106 with the resistance value R22, the drain potential value $V_0$ is obtained from the following equation (16).

$$\begin{aligned}V_0 &= (I1\times R22)+Vbe1 \\ &= (R22/R21)\times(kT/q)\times\ln(N)+Vbe1\end{aligned} \tag{16}$$

The first term (I1×R22) on the right side of equation (16) indicates a positive temperature coefficient with respect to absolute temperature. The second term (Vbe1) on the right side indicates the temperature coefficient of the base-emitter voltage of an npn bipolar transistor, which is approximately −2 mV/° C., exhibiting a negative dependency. As a result, the temperature dependency of the potential $V_0$ can be set to a positive or negative value or a substantially zero value by proper selection of the ratio of resistance values R22 and R21.

To estimate the voltage Vreg at the VREG terminal in FIG. 8A, since PMOS transistors 101, 102, and 103 form a current mirror circuit, their drain currents I1, I2, and I3 can be considered equal (I1=I2=I3). Since drain current I1 substantially equals the current through the resistor 106 with resistance value R21, the following equation (17) is true.

$$I1 = \Delta Vbe / R21 = (1/R21) \times (kT/q) \times \ln(N) \quad (17)$$

If I3 equals I1 (I3=I1), the voltage Vreg is given by the following equation (18).

$$Vreg = I3 \times R23 = (R23/R21) \times (kT/q) \times \ln(N) \quad (18)$$

Since Vreg is proportional to the absolute temperature T, its temperature coefficient is 1/T, equal to approximately +0.33%/° C. at room temperature.

Figure 9:
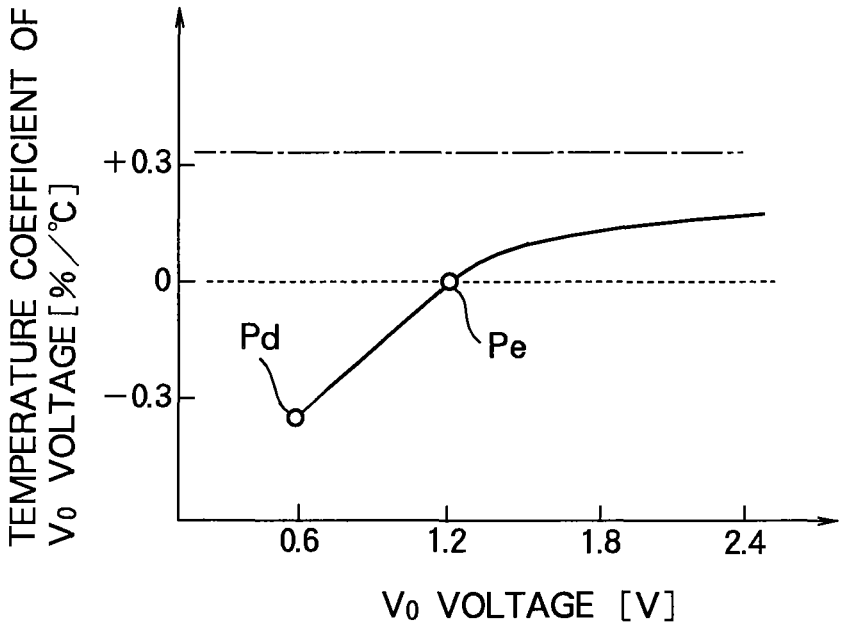
FIG. 9 is a graph showing electrical characteristics of the regulator circuit in FIGS. 8A and 8B.

The graph in FIG. 9 indicates the temperature coefficient of the voltage $V_0$ in the regulator circuit 41 in FIGS. 8A and 8B. In FIG. 9, the horizontal axis indicates the value of $V_0$ and the vertical axis indicates the temperature coefficient of $V_0$. Point Pd indicates the value when resistance value R22 is substantially zero, so that voltage $V_0$ corresponds to the base-emitter voltage Vbe1 of npn bipolar transistor 103, and its temperature dependency is approximately −2 mV/° C.

Assuming that the base-emitter voltage Vbe1 is 0.6 V, the temperature coefficient Tc is obtained from the following equation (19).

$$Tc = \{-2\ \text{mV}/^\circ\ \text{C.}\}/\{0.6\ \text{V}\} = \{-2 \times 10^{-3}\ \text{V}/^\circ\ \text{C.}\}/\{0.6\ \text{V}\} = -0.33\%/^\circ\ \text{C.} \quad (19)$$

Point Pe in FIG. 9 indicates the value corresponding to a voltage $V_0$ of approximately 1.2 V. This voltage $V_0$ is referred to as the band-gap reference voltage and its temperature coefficient is known to be substantially zero. If the resistance value R22 is taken in a wider range of values and the $V_0$ voltage is set to a greater value, on the right side of the equation (16), the value of the first term (I1×R22) dominates the value of the second term (Vbe1). The temperature coefficient Tc of the first term on the right side is 1/T. At a room temperature T of 300 kelvins (T=300 K), the temperature coefficient Tc in the following equation (20) is obtained.

$$Tc = +0.33\%/^\circ\ \text{C.} \quad (20)$$

In FIG. 9, the zero temperature coefficient (Tc=0) is indicated by a dotted line and the asymptotic line approached at higher $V_0$ voltages is indicated by the dash-dot line at +0.33%/° C. As seen in FIG. 9, if the drain potential $V_0$ of PMOS transistor 101 is used as the output voltage V1 of the regulator circuit 41 as in FIG. 8B, the temperature coefficient Tc can be set to a desired value in the range from +0.33%/° C. to −0.33%/° C. If the drain potential Vreg of PMOS transistor 103 is used as the output voltage V1 as in FIG. 8A, the output voltage V1 can be set arbitrarily by varying the resistance value R23 of the resistor 108. In this case, the temperature coefficient of the regulator circuit output voltage V1 (Vreg) has a constant value of approximately +0.33%/° C.

The temperature compensation section 72 in FIG. 7 is similar to the temperature compensation section 52 shown in FIG. 3, and the temperature coefficient Tc of the potential V2 is given by the following equation (21).

$$Tc = \frac{1}{V1 - Vbe}\left(\frac{\partial V1}{\partial T} - \frac{\partial Vbe}{\partial T}\right) \quad (21)$$

The current amplification ratio of npn bipolar transistor 42 is large and its base current is smaller than its emitter-collector current. As a result, the collector current of the npn bipolar transistor 42 in FIG. 7 substantially equals the emitter current Ie. The collector current of the npn bipolar transistor 42 is equal to the drain current of PMOS transistor 81. The gate-source voltages of PMOS transistors 81 and 82 are mutually identical, so PMOS transistors 81 and 82 constitute a current mirror, and their drain currents may be considered to be substantially equal, as in the following equation (22).

$$Ie \cong Iy \quad (22)$$

The emitter current Ie of npn bipolar transistor 42 is expressed by the following equation (23).

$$Ie = V2/R11 \quad (23)$$

The reference voltage is given by the following equation.

$$Vr = Iy \times R12 \quad (24)$$

From equations (23) and (24), the following equation (25) is obtained.

$$Vr = (R12/R11) \times V2 \quad (25)$$

From equation (25), it is clear that the voltage amplifying section 73 generates an output voltage Ve that is R12/R11 times the V2 potential. As a specific example, if the ratio of resistance values R11 and R12 in FIG. 7 is 1:2, a reference voltage Vr double the voltage V2 can be obtained.

From equation (1), $$V2 = V1 - Vbe$$

Thus the potential Vr at the VREF terminal can be obtained by the following equation (26).

$$Vr = (R12/R11) \times (V1 - Vbe) \quad (26)$$

Next, the temperature coefficient of the reference voltage Vr for the combination of the configurations in FIGS. 7 and 8A will be estimated. Assuming that Vr in equation (3) is V1, the following equation (27) is true.

$$Tc = \frac{1}{V1} * \frac{\partial V1}{\partial T} \quad (27)$$

Equation (27) can be rewritten as the following equation (28).

$$\frac{\partial V1}{\partial T} = Tc * V1 \tag{28}$$

In the regulator circuit output voltage Vreg at the VREG terminal in FIG. 8A, the temperature coefficient Tc is +0.33%/° C., so equation (28) can be used to estimate reference voltages Vr and their temperature coefficients for various settings.

Example 6

If Vreg is set to 1.2 V (Vreg=1.2 V) by selection of a suitable R23 value in FIG. 8A, then since V1 and Vreg are equal (V1=Vreg), the quantity ∂Vreg/∂T is obtained from the following equation.

$$\begin{aligned}(\partial Vreg/\partial T) &= Tc \times Vreg \\ &= 0.33 \times 10^{-2}/^\circ\text{ C.} \times 1.2\text{ V} \\ &= 0.4 \times 10^{-2}\text{ V}/^\circ\text{ C.}\end{aligned}$$

From equation (21), the temperature coefficient is expressed as follows.

$$\begin{aligned}Tc &= \{1/(Vreg - Vbe)\} \times (\partial Vreg/\partial T - \partial Vbe/\partial T) \\ &= \{1/(1.2\text{ V} - 0.6\text{ V})\} \times (0.4 \times 10^{-2} + 2 \times 10^{-3})\text{ V}/^\circ\text{ C.} \\ &= 1 \times 10^{-2}/^\circ\text{ C.} \\ &= +1\%/^\circ\text{ C.}\end{aligned}$$

Then from equation (26), $$Vr = (R12/R11) \times (Vreg - Vbe)$$

Therefore, if R12/R11 is equal to two (R12/R11=2), the following reference voltage Vr can be obtained:

$$\begin{aligned}Vr &= 2 \times (1.2\text{ V} - 0.6\text{ V}) \\ &= 1.2\text{ V}\end{aligned}$$

Example 7

If Vreg is set to 1.8 V (Vreg=0.8 V) by selection of a suitable R23 value in FIG. 8A, then since V1 and Vreg are equal (V1=Vreg), the quantity ∂Vreg/∂T is obtained from the following equation.

$$\begin{aligned}(\partial Vreg/\partial T) &= Tc \times Vreg \\ &= 0.33 \times 10^{-2}/^\circ\text{ C.} \times 1.8\text{ V} \\ &= 0.6 \times 10^{-2}\text{ V}/^\circ\text{ C.}\end{aligned}$$

From equation (21), the temperature coefficient Tc is expressed as follows.

$$\begin{aligned}Tc &= \{1/(Vreg - Vbe)\} \times (\partial Vreg/\partial T - \partial Vbe/\partial T) \\ &= (1/(1.8\text{ V} - 0.6\text{ V})) \times (0.6 \times 10^{-2} \times 2 \times 10^{-3}) \\ &= 0.66 \times 10^{-2} \\ &= +0.66\%/^\circ\text{ C.}\end{aligned}$$

From equation (26), it follows that:

$$Vr = (R12/R11) \times (Vreg - Vbe)$$

Accordingly, by setting R12/R11 to unity (R12/R11=1), the following reference voltage Vr is obtained.

$$\begin{aligned}Vr &= 1 \times (1.8\text{ V} - 0.6\text{ V}) \\ &= 1.2\text{ V}\end{aligned}$$

As described above, a reference voltage Vr with a comparatively large temperature coefficient can be obtained by taking the output of the regulator circuit 41 from the drain 103*d* of PMOS transistor 103 as in FIG. 8A. Alternatively, a relatively small temperature coefficient can be obtained by taking the output of the regulator circuit 41 from the drain 101*d* of PMOS transistor 101 as in FIG. 8B. In the both cases, the value of the reference voltage Vr can be set to a desired value by selecting an appropriate ratio of the resistance values R11 and R12 in FIG. 7. Like the first embodiment, the second embodiment enables the voltage value and the temperature coefficient of the reference voltage Vr to be set independently to desired values, eliminating the problem of the circuit shown in FIG. 5, in which a large temperature coefficient demands a low reference voltage Vra with high noise susceptibility. In Example 6, a temperature coefficient of +1%/° C., which is suitable for temperature compensation of AlGaInP LEDs, for example, is obtained with an output reference voltage Vr of 1.2 V.

An advantage of the reference voltage generating circuit in the second embodiment is that it can fit in a small chip area, because it does not include any large for component such as an operation amplifier.

Figure 10:
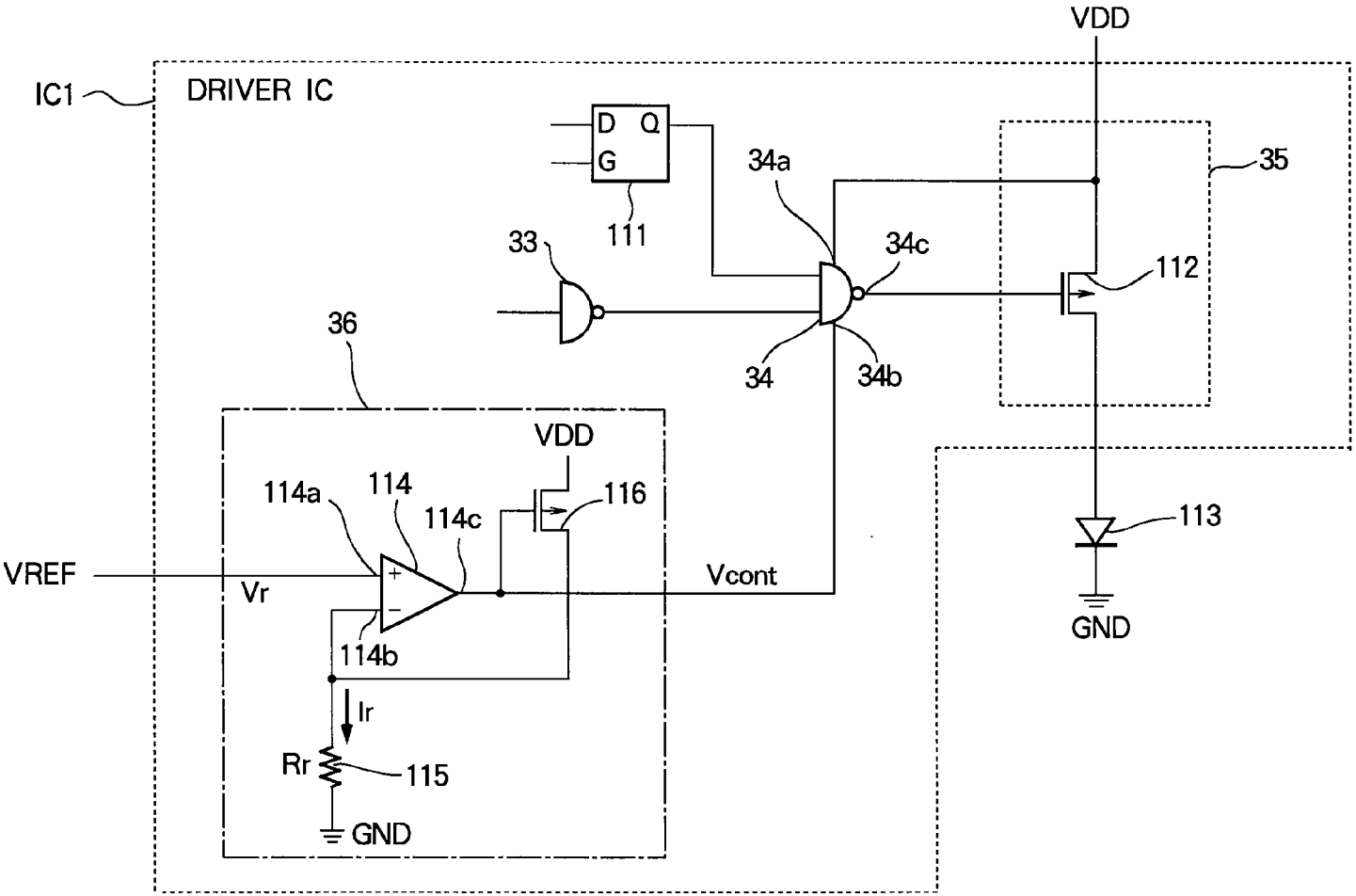
FIG. 10 is a circuit diagram schematically illustrating part of one of the driver ICs in FIG. 6.

The circuits in a driver IC in the second embodiment that are concerned with the printing of one dot by driving one LED are shown in FIG. 10. The flip-flop circuit 111 is part of the latch circuit 32 in FIG. 6. The inverter 33 is the inverter shown in FIG. 6, and the NAND gate 34 is one part of the NAND circuit 34 in FIG. 6. The LED drive circuit 35 includes a PMOS transistor 112 that drives one LED 113 in an LED array.

The control voltage generating circuit 36 shown in FIG. 10 is shared by all the drive circuitry in one driver IC. The control voltage generating circuit 36 includes an operational amplifier 114, a resistor 115 with a resistance value Rr, and a PMOS transistor 116. The voltage output from the operational amplifier 114 is supplied as a control voltage Vcont through the NAND gate 34 to the gate terminal of PMOS transistor 112 to adjust the drive current supplied to the LED 113.

The ground terminal 34*b* of the NAND gate 34 is accordingly connected to the output terminal 114*c* of the operational amplifier 114, while the power source terminal 34*a* of the NAND gate 34 is connected to the power source VDD. When the output terminal 34*c* of the NAND gate 34 is at the high logic level, its output potential is substantially equal to the potential Vdd of the power source VDD; when the output terminal 34*c* is at the low logic level, its output potential is substantially equal to the control voltage Vcont. The gate length of PMOS transistor 116 is proportional to the gate length of PMOS transistor 112.

The VREF terminal is connected to the inverting input terminal 114*a* of the operational amplifier 114, and receives the reference voltage Vr generated by the reference voltage generating circuit 70*a* shown in FIG. 7. The operational amplifier 114, resistor 115, and PMOS transistor 116 form a feedback control circuit that holds the current Ir flowing through the resistor 115, and thus through PMOS transistor 116, to a value that depends only on the reference voltage Vr and the resistance value Rr of resistor 115, and does not depend on the potential Vdd of the power source VDD. More specifically, the operational amplifier 114 holds the current Ir at a value such that the potentials at its inverting input terminal 114*a* and non-inverting input terminal 114*b* are substantially equal, making the potential at the non-inverting terminal 114*b* substantially equal to the reference voltage Vr. The current Ir is accordingly given by the following equation (29).

$$Ir=Vr/Rr \tag{29}$$

As noted above, PMOS transistors 112 and 116 have proportional gate lengths. When the LED 113 is driven, the gate potentials of PMOS transistors 112 and 116 are both equal to the control voltage Vcont, and both transistors operate in their saturation regions, so they form a current mirror and the drive current supplied to the LED 113 is proportional to the reference current Ir, which is proportional to the reference voltage Vr input at the VREF terminal. The drive currents supplied to the LEDs are therefore all adjusted in unison by means of the reference voltage Vr.

As described above, the configuration of the driving circuit in the second embodiment makes it possible to set both the voltage value and the temperature coefficient of the reference voltage Vr to desired values. In particular, regardless of the temperature coefficient, the voltage value of the reference voltage Vr can be high enough to make noise voltages negligible by comparison, thereby avoiding noise-induced variations in LED drive current. Moreover, this effect is obtained with a reference voltage generating circuit 70*a* that does not require a large component such as an operation amplifier. The cost of the reference voltage generating circuit 70*a* is correspondingly low.

The second embodiment permits variations in the configurations of the temperature compensation section 52 and voltage amplifying section 53 of the reference voltage generating circuit. Two variations will be described below; other variations are possible as well.

Figure 11:
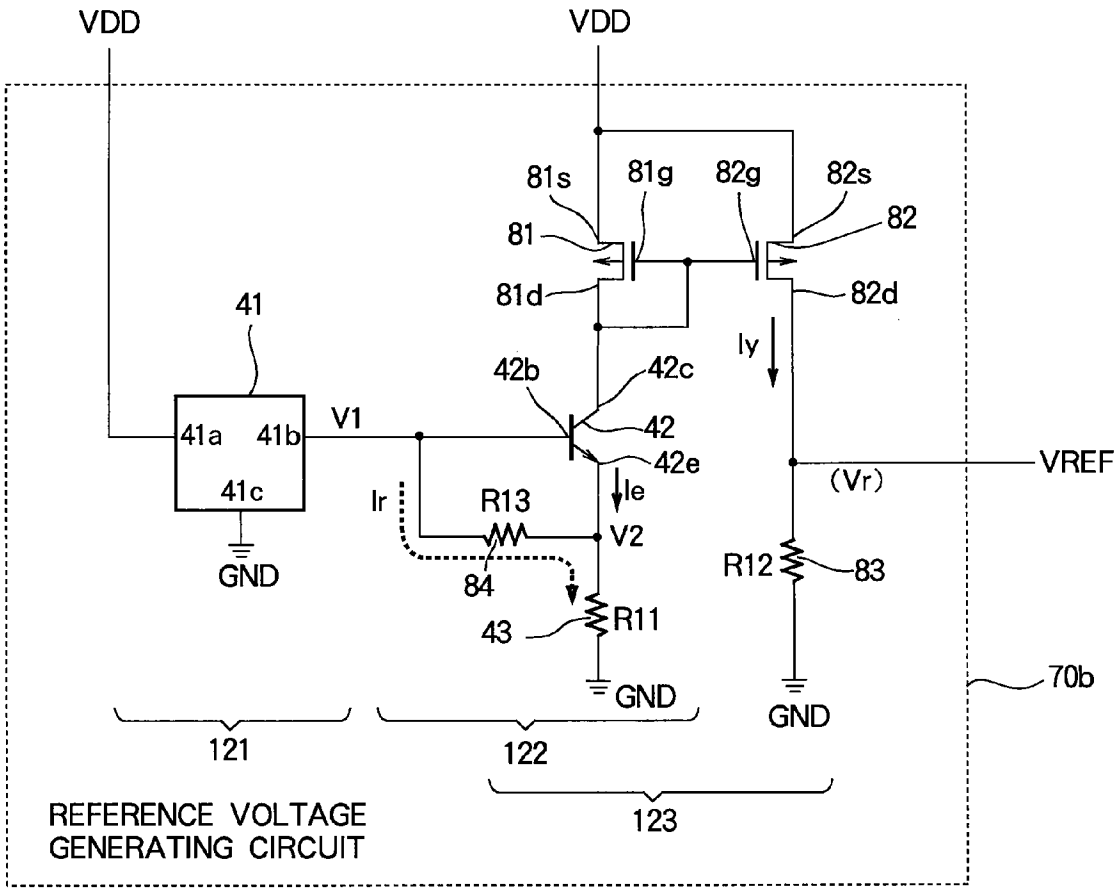
FIG. 11 is a circuit diagram schematically illustrating an alternative configuration of the reference voltage generating circuit in FIG. 6.

Referring to FIG. 11, in one variation, the reference voltage generating circuit 70*b* includes an additional resistor 84 connected between the base terminal 42*b* and emitter terminal 42*e* of npn bipolar transistor 42. Aside from this difference, the regulating section 121, temperature compensation section 122, and voltage amplifying section 123 in FIG. 11 are similar to the regulating section 71, temperature compensation section 72, and voltage amplifying section 73 in FIG. 7.

The resistance values of the resistors 43, 83, 84 in FIG. 11 are R11, R12, R13, respectively. The symbols V1, V2, Vr, Ie, and Iy have the same meaning as in FIG. 7.

The resistor 84 added to the reference voltage generating circuit 70*b* in FIG. 11 allows a current Ir indicated by the dotted arrow in FIG. 11 to flow from the output terminal 41*b* of the regulator circuit 41 through resistors 84 and 43 to ground. The output voltage V1 of the regulator circuit 41 is not affected by the presence of resistor 84, and the base-emitter voltage Vbe of the npn bipolar transistor 42 is substantially constant, so the V2 potential is also substantially unchanged. The current flow through resistor 43 is therefore independent of the resistance value R13 of resistor 84. Consequently, the emitter current Ie of the npn bipolar transistor 42 is reduced by an amount equal to the current flow Ir through resistor 84.

The current Ir mainly depends on the output voltage V1 of the regulator circuit 41 and the resistance values R13 and R11 of resistors 84 and 43, so its temperature dependency can be reduced to a small value. The base current of the npn bipolar transistor 42 is negligibly small, so the collector current is substantially equal the emitter current Ie. As the PMOS transistors 81 and 82 constitute a current mirror circuit, their drain currents can be made substantially identical to each other. If this is done, the drain current Iy of PMOS transistor 82 equals the drain current of PMOS transistor 81, which is the collector current of npn bipolar transistor 42, and is therefore substantially equal to the emitter current Ie. If the resistance value R13 of resistor 84 is reduced and current Ir is increased, current Ie is reduced by an equal amount, and current Iy is likewise reduced, but the reference voltage Vr can be kept at the prescribed level by increasing the resistance value R12 of resistor 83. Since the temperature dependent current Ie is reduced and the temperature independent current Ir is increased, the temperature coefficient is reduced.

Figure 12:
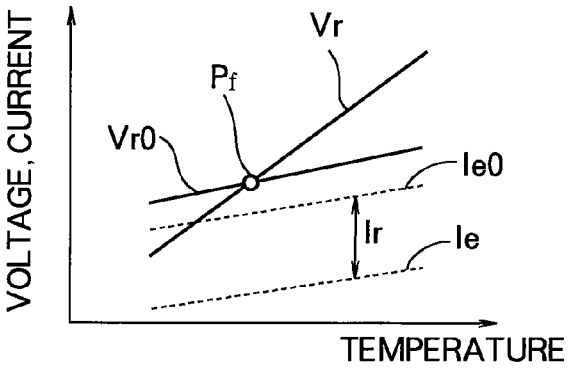
FIG. 12 is a graph showing electrical characteristics of the reference voltage generating circuit in FIG. 11.

The emitter current of npn bipolar transistor 42 is indicated by the dotted lines Ie0 and Ie in the graph FIG. 12: Ie0 indicates the emitter current of npn bipolar transistor 42 in FIG. 7 and Ie indicates the emitter current of npn bipolar transistor 42 in FIG. 11. The shift between these two lines is due to the Ir current. Although both lines have substantially equal slope, the lower line Ie has a higher temperature coefficient Tc than the upper line Ie0. The line marked Vr in FIG. 12 indicates the output voltage Vr of the reference voltage generating circuit 70*b* in FIG. 11; the line marked Vr0 indicates the output voltage of the reference voltage generating circuit 70*a* in FIG. 7 for comparison.

In both FIGS. 7 and 11 the output reference voltage is generated by multiplying the emitter current of the npn bipolar transistor 42 by a constant value, but this constant is higher in the voltage amplifying section 123 in FIG. 11 than in the voltage amplifying section 73 in FIG. 7. This is apparent in FIG. 12: the reference voltage Vr0 is a constant multiple of current Ie0, and reference voltage Vr is a higher constant multiple of current Ie. The reference voltage lines Vr0 and Vr intersect at point Pf in FIG. 12, where both the reference voltage generating circuit 70*a* in FIG. 7 and reference voltage generating circuit 70*b* in FIG. 11 generate at the same output voltage at the same temperature. On both sides of this point, line Vr has a greater slope than line Vr0, and since the slope of the output line is the temperature coefficient Tc, reference voltage generating circuit 70*b* in FIG. 11 has a higher temperature coefficient than the voltage generating circuit 70*a* in FIG. 7.

Figure 13:
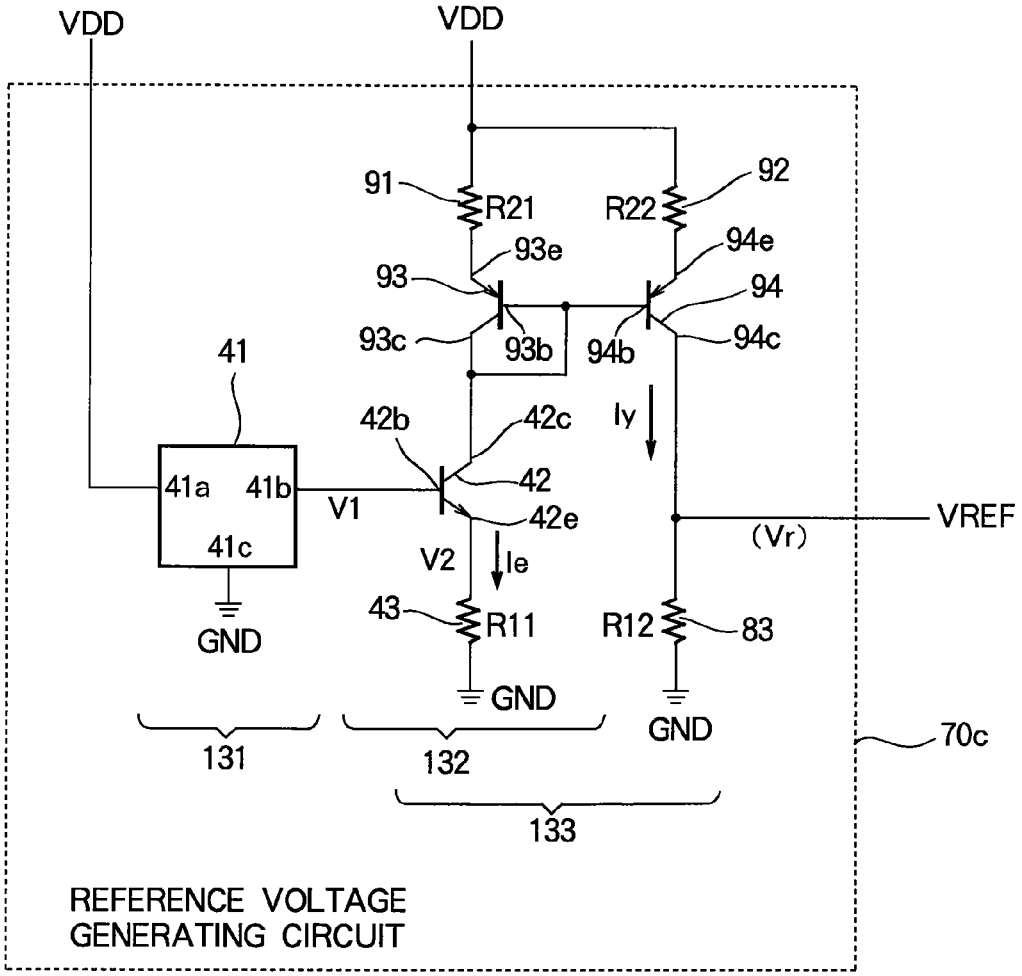
FIG. 13 is a circuit diagram schematically illustrating another alternative configuration of the reference voltage generating circuit in FIG. 6.

Referring to FIG. 13, in another variation the reference voltage generating circuit 70*c* includes the regulator circuit 41, npn bipolar transistor 42, and resistors 43, 83, additional resistors 91, 92, and pnp bipolar transistors 93 and 94 instead of the PMOS transistors used in FIG. 7. As in FIG. 7, the regulator circuit 41 has a power terminal 41*a* connected to the power source VDD, a ground terminal 41*c* connected to ground, and an output terminal 41*b* connected to the control terminal or base terminal 42*b* of npn bipolar transistor 42, and the first main terminal or emitter terminal 42*e* of npn bipolar transistor 42 is connected to ground through resistor 43. The first main terminals or emitter terminals 93*e*, 94*e* of the pnp bipolar transistors 93, 94 are connected to the power source VDD through resistors 91, 92, respectively. The control terminals or base terminals 93*b*, 94*b* of the pnp bipolar transistors 93, 94 are mutually interconnected, and both base terminals 93*b*, 94*b* are also connected to the second main terminals or collector terminals 42*c*, 93*c* of npn bipolar transistor 42 and pnp bipolar transistor 93. The second main terminal or collector terminal 94*c* of pnp bipolar transistor 94 is connected to ground through resistor 83, and to the output terminal VREF.

The resistance values of the resistors 43, 83, 91, and 92 in FIG. 13 are respectively R11, R12, R21, and R22. The symbols V1, V2, Vr, Ie, and Iy have the same meaning as in FIG. 7. Functionally, the reference voltage generating circuit 70*c* is divided into three sections: a regulating section 131 including the regulator circuit 41, a temperature compensation section 132 including npn bipolar transistor 42 and resistor 43, and a voltage amplifying section 133 including resistors 83, 91, and 92 and pnp bipolar transistors 93 and 94.

Resistors 91, 92 and pnp bipolar transistors 93, 94 constitute a current mirror circuit that operates similarly to the current mirror in FIG. 7. Differing from the reference voltage generating circuit 70*a* in FIG. 7, however, if the pnp bipolar transistors 93 and 94 in FIG. 13 have similar characteristics, the currents Ie and Iy in the reference voltage generating circuit 70*c* can be determined primarily by the resistance values R21 and R22.

If these resistance values R21 and R22 are mutually equal and are sufficiently large, currents Ie and Iy become substantially identical, even if there is some difference between the characteristics of the pnp bipolar transistors 93 and 94. This is particularly advantageous when the reference voltage generating circuit 70*c* is assembled by mounting discrete components such as transistors and resistors on a printed-wiring board, since precisely matched resistors can be obtained more easily than precisely matched transistors. The desired reference voltage can be obtained by selection of resistors 43, 83 with an appropriate resistance ratio, as in the reference voltage generating circuit 70*a* in FIG. 7.

Third Embodiment

Figure 14:
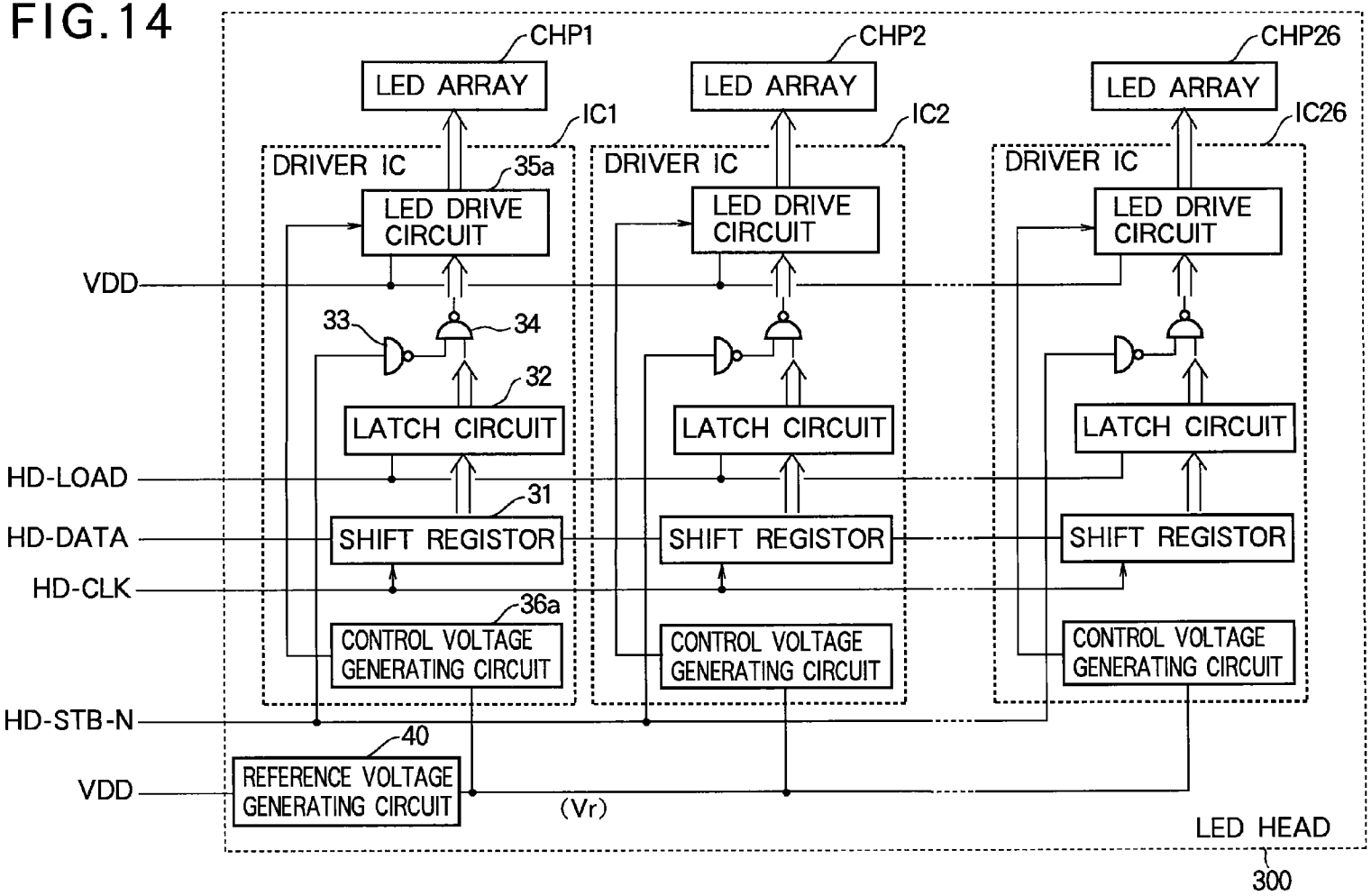
FIG. 14 is a block diagram schematically illustrating the functional configuration of the LED head in FIG. 1 in a third embodiment of the invention.

Referring to FIG. 14, the LED head 300 in the third embodiment has the same configuration as the LED head 100 in the first embodiment but differs in the internal configuration of the LED drive circuits 35*a* and control voltage generating circuits 36*a* in the driver ICs. In the third embodiment, a temperature compensation function is present in the control voltage generating circuits 36*a*, and the operational amplifiers conventionally used in the control voltage generating circuits are unnecessary.

Figure 15:
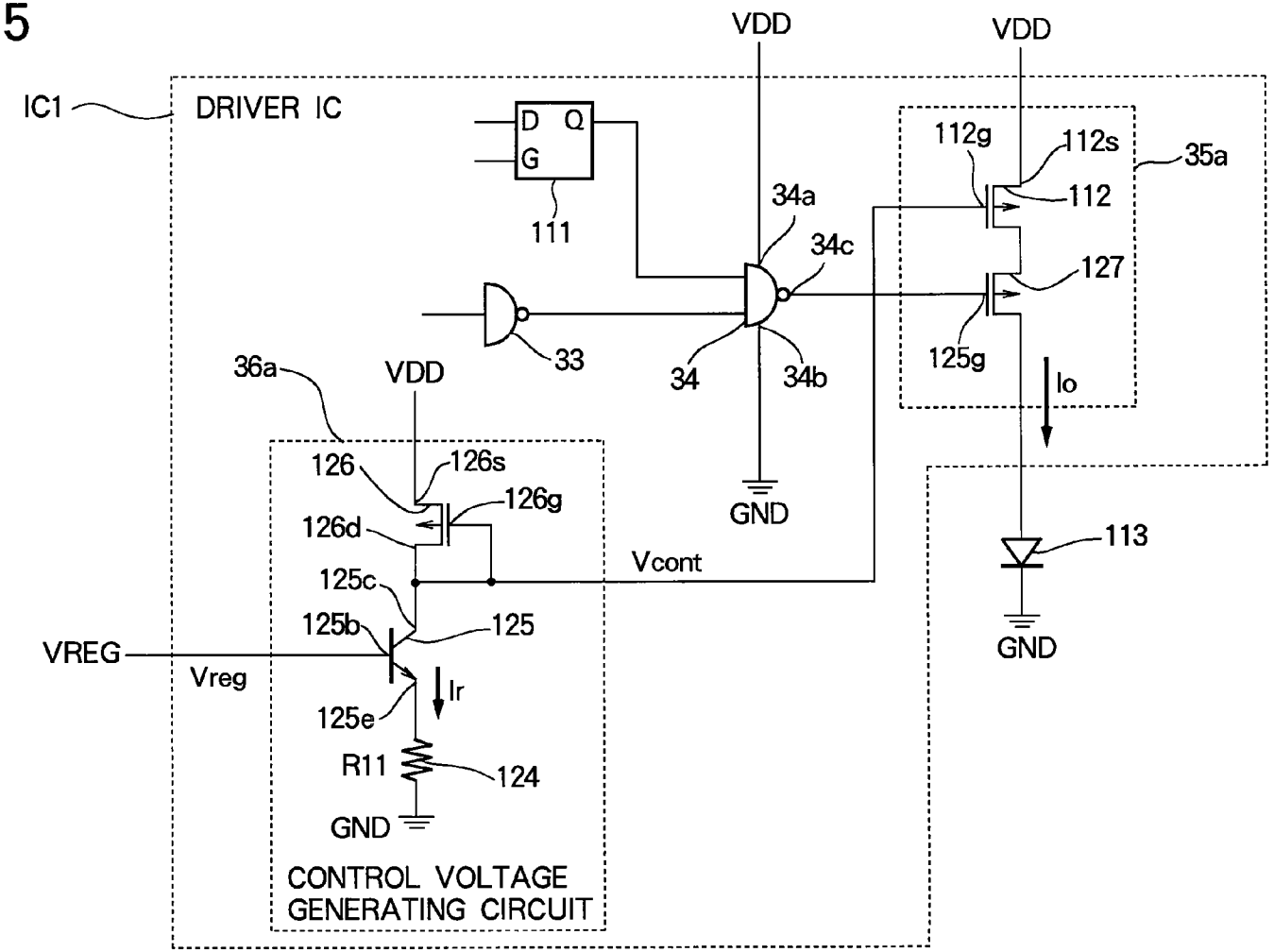
FIG. 15 is a circuit diagram schematically illustrating part of one of the driver ICs in FIG. 14.

FIG. 15 shows the circuits involved in the driving of one dot in the third embodiment, including an inverter 33, a NAND gate 34, an LED drive circuit 35*a*, a control voltage generating circuit 36*a*, and a flip-flop circuit 111. The LED drive circuit 35*a* includes a PMOS transistor 112 and a PMOS transistor 127 that feed current to an LED 113, which is the driven element. The control voltage generating circuit 36*a* includes a resistor 124, an npn bipolar transistor 125, and a PMOS transistor 126.

The inverter 33 in FIG. 15 is as shown in FIG. 14. The flip-flop circuit 111 in FIG. 15 forms part of the latch circuit 32 in FIG. 14. The NAND gate 34 is part of the NAND circuit 34 in FIG. 14. PMOS transistor 112 determines the value of the current Io fed to the LED 113. PMOS transistor 127 switches the current Io on and off.

As indicated in FIG. 14, each driver IC has one control voltage generating circuit 36*a*, which is shared by all the drive circuitry in the driver IC. As shown in FIG. 15, PMOS transistor 126 in the control voltage generating circuit 36*a* has its source terminal 126*s* connected to the power source VDD, and its gate terminal 126*g* and drain terminal 126*d* connected to the collector terminal 125*c* of npn bipolar transistor 125, from which terminal the control voltage Vcont is output. The control voltage Vcont is supplied to the gate terminal 112*g* of PMOS transistor 112 in the LED drive circuit 35*a* to adjust the amount of current supplied to the LED 113.

The NAND gate 34 has a power supply terminal 34*a* connected to the power source VDD and a ground terminal 34*b* connected to ground. When the output terminal 34*c* of the NAND gate 34 is at the high logic level, the NAND output potential is substantially equal to the potential Vdd of the power source VDD; when the output terminal 34*c* is at the low logic level, the NAND output potential is substantially equal to the ground potential. The output terminal 34*c* of the NAND gate 34 is connected to the gate terminal 125*g* of PMOS transistor 127. PMOS transistor 127 is accordingly switched off when the output terminal 34*c* of the NAND gate 34 is at the high logic level, and on when the output terminal 34*c* is at the low logic level. When PMOS transistor 127 is switched on, the amount of current Io determined by PMOS transistor 112 is supplied to the LED 113.

Since the gate lengths of PMOS transistors 112 and 122 are proportional, their source terminals 112*s*, 122*s* are at mutually identical potentials, and their gate terminals 112*g*, 122*g* are at mutually identical potentials, PMOS transistors 112 and 122 form a current mirror.

The regulated output voltage Vreg generated by the regulator circuit 41 shown in FIG. 8A, for example, is input to the VREG terminal. The VREG terminal is connected to the base terminal 123*b* of npn bipolar transistor 125, which has its collector terminal 123*c* connected to the drain terminal 122*d* of PMOS transistor 126 and its emitter terminal 123*e* connected to ground through resistor 124.

In FIG. 15, the base current of npn bipolar transistor 125 is negligible in comparison with the emitter and collector currents of this transistor 125, so the relationship between the regulator circuit output voltage Vreg and the reference current Ir can be expressed by the following equation (30):

$$Ir=(Vreg-Vbe)/R11 \quad (30)$$

In the equation above, Vbe indicates the base-emitter voltage of npn bipolar transistor 125 and R11 indicates the resistance value of resistor 124. The regulator circuit output voltage Vreg is held at a prescribed value by the regulator circuit 41. The base-emitter voltage Vbe also has a prescribed value, typically about 0.6 V. Accordingly, the reference current Ir can be set to a desired value by selection of a resistor 124 with an appropriate resistance value R11.

PMOS transistors 112 and 122 have identical gate lengths, and their gate potentials are identically equal to the control voltage Vcont. PMOS transistors 112 and 122 both operate in their saturation region and thus constitute a current mirror circuit. As a result, the drive current Io supplied to the LED 113 is proportional to the reference current Ir. The reference current Ir is determined by the regulator circuit output voltage Vreg input to the VREG terminal, so all the LED drive currents supplied from one driver IC can be adjusted in unison by adjusting the regulator circuit output voltage Vreg. In addition, the npn bipolar transistor 125 in the control voltage generating circuit 36*a* in FIG. 15 provides a temperature compensation function by giving the drive current Io of the LED 113 a positive temperature coefficient.

Examples of the temperature coefficient will now be described. If the constant of proportionality between the LED drive current Io and the reference current Ir is K, the following relational expression (31) is true.

$$Io=K\times Ir \tag{31}$$

Since $$Ir=(V\text{reg}-Vbe)/R11$$

the following equation (32) is true.

$$Io=K\times(V\text{reg}-Vbe)/R11 \tag{32}$$

The temperature coefficient Tc of the drive current Io is given by the following equation (33), in which T indicates temperature.

$$Tc=\frac{1}{Io}\frac{\partial Io}{\partial T} \tag{33}$$

If the temperature dependency of the resistance value R11 of resistor 124 is negligibly small, the following equation (34) is obtained.

$$Tc=\frac{1}{Vreg-Vbe}\left(\frac{\partial Vreg}{\partial T}-\frac{\partial Vbe}{\partial T}\right) \tag{34}$$

If, for simplification, the temperature coefficient of the output voltage of the regulator circuit 41 is zero, which is obtainable with the alternative regulator circuit configuration in FIG. 8B, the first term in the parentheses on the right side of equation (34) can be ignored, so the following equation (35) is obtained.

$$Tc=\frac{1}{Vreg-Vbe}\left(-\frac{\partial Vbe}{\partial T}\right) \tag{35}$$

Given that the base-emitter voltage Vbe of the npn bipolar transistor 125 has a temperature dependency of approximately −2 mV/° C., the control voltage generating circuit 36*a* in FIG. 15 provides a positive temperature coefficient, and thus increases the drive current Io as the temperature rises, compensating for the reduction in LED optical emission. A specific example is given below.

Example 8

When Vreg is 1.2 V (Vreg=1.2 V) and Vbe is 0.6 V (Vbe=0.6 V), the temperature coefficient Tc of the LED drive current Io is expressed as follows.

$$Tc=1/(1.2\text{ V}-0.6\text{ V})\times\{-(-2\text{ mV}/^\circ\text{ C.})\}$$
$$=+0.33\%/^\circ\text{ C.}$$

The LED drive current Io can be set by selecting a proper resistance value R11 and mirror ratio K, and is adjustable separately from the temperature coefficient value.

As described in detail above, the drive circuit in the third embodiment enables the LED drive current Io and its temperature coefficient Tc to be set independently to desired values. Accordingly, the temperature coefficient Tc can be set to a value that provides correct temperature compensation for the type of LEDs used, while the reference voltage Vreg that controls the LED drive current can have a value large enough to make the effects of noise voltage negligible.

The drive circuit in the third embodiment is low in cost because it includes no operational amplifier or other large components.

Figure 16:
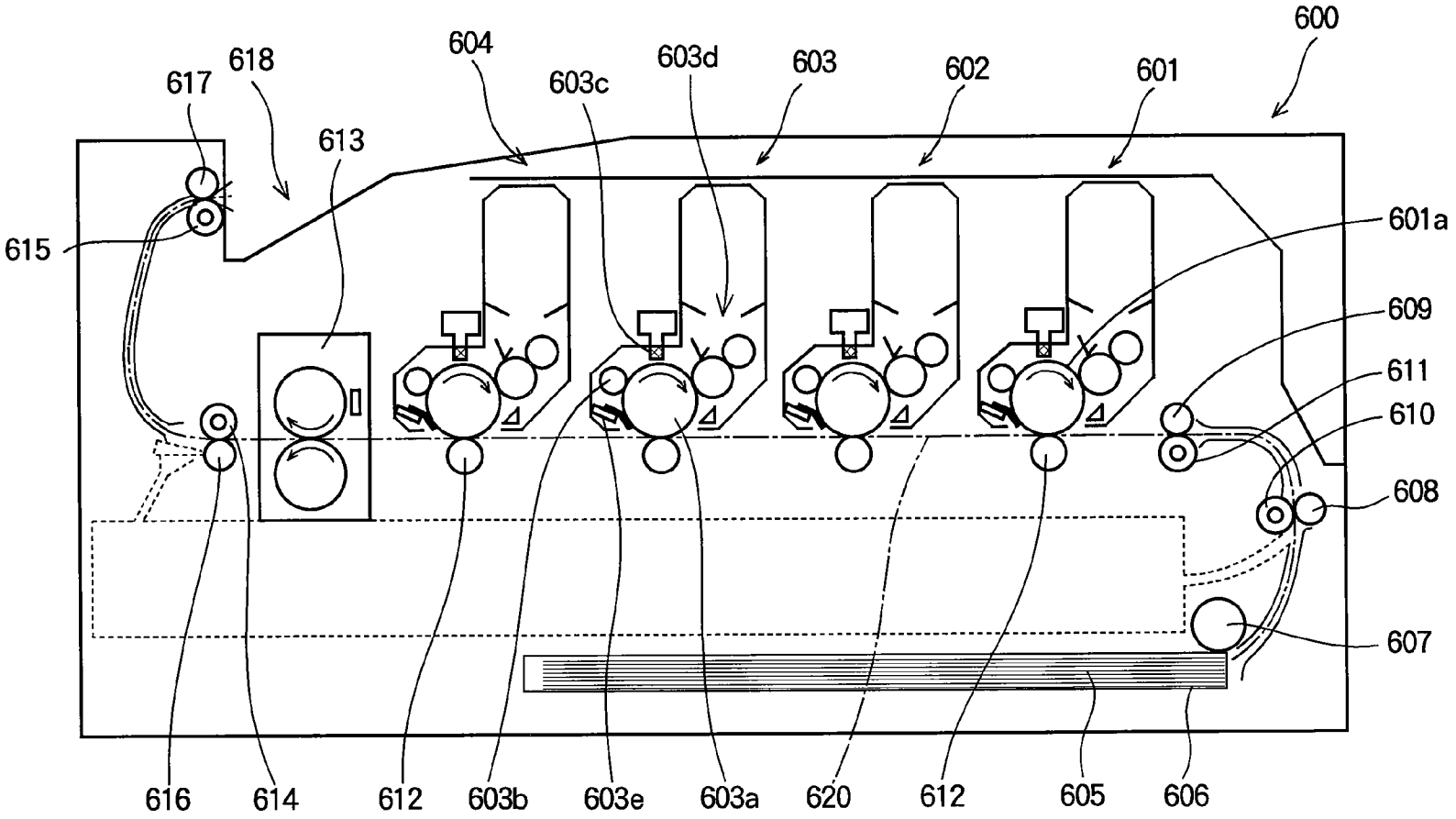
FIG. 16 is a cross-sectional view schematically illustrating the mechanical configuration of a tandem color LED printer in which the invention may be used.

The electrophotographic print heads described in the preceding embodiments can be used in, for example, the tandem color printer illustrated in FIG. 16. This printer 600 includes process units 601 to 604 that print respective monochrome black (K), yellow (Y), magenta (M), and cyan (C) images. These units are placed one after another in the transport path of the recording medium 605. The process units 601 to 604 have the same internal structure. The internal structure of the magenta process unit 603 will be described below.

Process unit 603 includes a photosensitive drum 603*a* that turns in the direction indicated by the arrow. Disposed around the photosensitive drum 603*a* are a charger 603*b* for charging the surface of the photosensitive drum 603*a* by supplying electrical charge, an exposure unit 603*c* for forming a latent image by selectively illuminating the surface of the charged photosensitive drum 603*a*, a developing unit 603*d* for forming a toner image by applying magenta toner to the surface of the photosensitive drum 603*a* on which a latent image is formed, and a cleaning unit 603*e* for removing toner left after the toner image is transferred from the photosensitive drum 603*a*. The LED head described in any one of the three preceding embodiments is used as the exposure unit 603*c*. The drums and rollers used in the process units are driven by a motor such as the develop/transfer process motor 14 in FIG. 1.

The printer 600 has at its bottom a paper cassette 606 for holding a stack of paper or other recording media 605. Disposed above the paper cassette 606 is a hopping roller 607 for taking sheets of the recording medium 605 separately from the paper cassette 606. Disposed downstream of the hopping roller 607 in the transport direction of the recording medium 605 are a pair of pinch rollers 608, 609, a transport roller 610 for transporting the recording medium 605 past pinch roller 608, and a registration roller 611 for transporting the recording medium 605 past pinch roller 609. The hopping roller 607, transport roller 610, and registration roller 611 are driven by a motor such as the paper transport motor 16 in FIG. 1.

Each of the process units 601 to 604 also includes a transfer roller 612, made of a semiconductive rubber or similar material, facing the photosensitive drum. A voltage applied to the transfer roller 612 creates an electrical potential difference between the surfaces of the photosensitive drum and the transfer roller 612. This potential difference transfers the toner image formed on the photosensitive drum onto the recording medium 605.

A fuser 613, which includes a heating roller and a backup roller, fuses the toner image onto the recording medium 605 by pressure and heat. A pair of delivery rollers 614 and 615 and a pair of pinch rollers 616 and 617 disposed downstream of the fuser 613 transport the recording medium 605 from the fuser 613 to a recording medium stacker 618. The delivery rollers are also driven by a motor and gears (not shown).

The operation of the tandem color printer 600 will be described briefly. The hopping roller 607 picks up the sheet at the top of the stack of recording medium 605 in the paper cassette 606. The recording medium 605 is carried between the transport roller 610 and pinch roller 608, aligned against the registration roller 611 and pinch roller 609, and then carried between the registration roller 611 and pinch roller 609 into the black process unit 601. As the recording medium 605 is transported between the photosensitive drum and transfer roller of process unit 601 by the rotation of its photosensitive drum, a toner image is transferred onto the recording surface of the recording medium 605.

The recording medium 605 then passes through the other process units 602 to 604, which transfer toner images of other colors onto its recording surface. The toner images of all four colors are fused onto the recording medium 605 by the fuser 613 to form a full-color image, and the recording medium 605 is ejected by the delivery rollers 614 and 615 and their pinch rollers 616 and 617 onto the recording medium stacker 618 outside the printer 600.

A printer, copier, or similar image forming apparatus using any of the LED heads in the embodiments described can produce images of consistently high quality.

Similar effects can be obtained not only in full-color image forming apparatus as described above but also in monochrome and multiple-color image forming apparatus, but greatest advantages can be obtained in full-color image forming apparatus with many optical printing heads.

Applications of the invention are also envisioned in the driving of light-emitting thyristors, light-emitting transistors, organic light-emitting diodes (OLEDs), and resistive heating elements. For example, the invention can be used in electrophotographic printers having OLED heads with arrays of OLEDs, light-emitting thyristor heads with arrays of three-terminal or four-terminal light-emitting thyristors, or thermal printers having arrays of resistive heating elements.

The present invention can be also applied to the driving of an array of display elements arranged in a row or matrix, by control of the voltage applied to the display elements. For example, the invention can be employed with an array of thyristors used as switching elements for driving arrays or matrices of display elements.

Those skilled in the art will recognize that further variations are possible within the scope of the invention, which is defined in the appended claims.

What is claimed is:

1. A driving circuit for receiving a first power source potential and a second power source potential and driving a driven element, the driving circuit comprising:

a reference voltage generating circuit for generating a reference voltage; and a driver circuit for receiving the reference voltage and driving the driven element at a level responsive to the reference voltage; wherein the reference voltage generating circuit includes a regulating circuit for generating a first voltage, a temperature compensation circuit for receiving the second power source potential and the first voltage and generating a second voltage as a temperature-compensated voltage on the basis of the first voltage and a temperature of the temperature compensation circuit, and a voltage amplifying circuit including the temperature compensation circuit, the voltage amplifying circuit receiving the first and second power source potentials, generating the reference voltage that is proportional to the second voltage output from the temperature compensation circuit, and supplying the reference voltage to the driver circuit, wherein the temperature compensation circuit further comprises:

a sixth transistor having a first terminal for receiving the first voltage output from the regulating circuit, a second terminal, and a third terminal, and a seventh resistor having one terminal connected to the second terminal of the sixth transistor and another terminal for receiving the second power source potential, the sixth transistor and the seventh resistor forming an emitter follower circuit; and the voltage amplifying circuit further comprises a current mirror connected to the third terminal of the sixth transistor, the current mirror receiving the first power source potential and outputting the reference voltage.

2. The driving circuit of claim 1, wherein the regulating circuit further comprises:

a first transistor having a first main terminal for receiving the first power source potential, a control terminal, and a second main terminal;

a second transistor having a first main terminal for receiving the first power source potential, a control terminal connected to the control terminal of the first transistor, and a second main terminal connected to the control terminals of the first and second transistors;

a third transistor having an emitter terminal for receiving the second power source potential, a base terminal, and a collector terminal;

a fourth transistor having an emitter terminal for receiving the second power source potential, a base terminal connected to the collector terminal of the third transistor, and a collector terminal connected to the second main terminal of the second transistor;

a first resistor having one terminal connected to the second main terminal of the first transistor and another terminal connected to the base terminal of the third transistor; and a second resistor having one terminal connected to the collector terminal of the third transistor and another terminal connected to the base terminal of the third transistor;

the third and fourth transistors being bipolar transistors.

3. The driving circuit of claim 2, wherein the first voltage is output from the second main terminal of the first transistor.

4. The driving circuit of claim 2, wherein the regulating circuit further comprises:

a fifth transistor having a first main terminal for receiving the first power source potential, a control terminal connected to the drain terminal of the second transistor, and a second main terminal for output of the first voltage; and a third resistor having one terminal connected to the second main terminal of the fifth transistor and another terminal for receiving the second power source potential.

5. The driving circuit of claim 1, wherein:

the first terminal is a base terminal for receiving the first voltage, the second terminal is a collector terminal, the third terminal is an emitter terminal for output of the second voltage, the current mirror receives a collector potential from the collector terminal of the sixth transistor, conducts a first current, responsive to the collector potential, from a node at the first power source potential to the collector terminal of the sixth transistor, and conducts a second current, proportional to the first current, from the node at the first power source potential; and the voltage amplifying circuit further comprises an eighth resistor having one terminal for receiving the second power source potential and another terminal for receiving the second current and outputting the reference voltage.

6. The driving circuit of claim 5, wherein the temperature compensation circuit further comprises a ninth resistor having one terminal connected to the base terminal of the sixth transistor another terminal connected to the emitter terminal of the sixth transistor.

7. The driving circuit of claim 5, wherein the current mirror further comprises:

a seventh transistor having a first main terminal for receiving the first power source potential, a control terminal connected to the collector terminal of the sixth transistor, and a second main terminal connected to the collector terminal of the sixth transistor; and an eighth transistor having a first main terminal for receiving the first power source potential, a control terminal connected to the collector terminal of the sixth transistor, and a second main terminal connected to the eighth resistor.

8. The driving circuit of claim 5, wherein the voltage amplifying circuit further comprises:

a tenth resistor connected to the current mirror, for conducting the first current from the node at the first power source potential into the current mirror; and an eleventh resistor connected to the current mirror, for conducting the second current from the node at the first power source potential into the current mirror.

9. The driving circuit of claim 8, wherein the current mirror further comprises:

a ninth transistor having an emitter terminal for receiving the first power source potential, a base terminal connected to the collector terminal of the sixth transistor, and a collector terminal connected to the collector terminal of the sixth transistor; and a tenth transistor having an emitter terminal for receiving the first power source potential, a base terminal connected to the collector terminal of the sixth transistor, and a collector terminal connected to the eighth resistor;

the ninth and tenth transistors being bipolar transistors.

10. The driving circuit of claim 1, wherein the driver circuit further comprises:

a control voltage generating circuit for receiving the reference voltage and generating a control voltage at a level responsive to the reference voltage; and a drive circuit for receiving the control voltage and driving the driven element at a level responsive to the control voltage.

11. The driving circuit of claim 10, wherein:

the control voltage generating circuit further comprises:

an eleventh transistor having a first main terminal for receiving the first power source potential, a second main terminal for output of the control voltage, and a control terminal connected to the second main terminal of the eleventh transistor;

a twelfth transistor having a collector terminal connected to the second main terminal of the eleventh transistor, a base terminal for receiving the first voltage, and an emitter terminal, and;

a twelfth resistor having one terminal connected to the emitter terminal of the twelfth transistor and another terminal for receiving the second power source potential, the twelfth transistor and the twelfth resistor forming an emitter follower circuit;

the twelfth transistor being a bipolar transistor.

12. A driving apparatus comprising the driving circuit of claim 1 and the element to be driven.

13. An image forming apparatus having an optical print head including the driving apparatus of claim 12.

14. The driving circuit of claim 1, wherein the temperature compensation circuit further comprises a ninth resistor having one terminal connected to the first terminal of the sixth transistor another terminal connected to the second terminal of the sixth transistor, and the current mirror further comprises:

a seventh transistor having a first main terminal for receiving the first power source potential, a control terminal connected to the third terminal of the sixth transistor, and a second main terminal connected to the third terminal of the sixth transistor; and an eighth transistor having a first main terminal for receiving the first power source potential, a control terminal connected to the third terminal of the sixth transistor, and a second main terminal connected to the eighth resistor.

15. The driving circuit of claim 1, wherein the voltage amplifying circuit further comprises:

a tenth resistor connected to the current mirror, for conducting the first current from the node at the first power source potential into the current mirror; and an eleventh resistor connected to the current mirror, for conducting the second current from the node at the first power source potential into the current mirror, and the current mirror further comprises:

a ninth transistor having an emitter terminal for receiving the first power source potential, a base terminal connected to the third terminal of the sixth transistor, and a collector terminal connected to the third terminal of the sixth transistor; and a tenth transistor having an emitter terminal for receiving the first power source potential, a base terminal connected to the third terminal of the sixth transistor, and a collector terminal connected to the eighth resistor;

the ninth and tenth transistors being bipolar transistors.

* * * * *